US011975906B2

(12) United States Patent
Kamigaki et al.

(10) Patent No.: US 11,975,906 B2
(45) Date of Patent: May 7, 2024

(54) CUSHIONING MATERIAL, PACKING MATERIAL, AND PACKED GOODS

(71) Applicant: SEIKO EPSON CORPORATION, Tokyo (JP)

(72) Inventors: Shinya Kamigaki, Shiojiri (JP); Sanshiro Takeshita, Shiojiri (JP); Haoki Fushimi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 18/053,007

(22) Filed: Nov. 7, 2022

(65) Prior Publication Data

US 2023/0141442 A1 May 11, 2023

(30) Foreign Application Priority Data

Nov. 9, 2021 (JP) ..... 2021-182458

(51) Int. Cl.
*B65D 81/05* (2006.01)
*B65D 85/68* (2006.01)

(52) U.S. Cl.
CPC ..... *B65D 81/056* (2013.01); *B65D 81/057* (2013.01); *B65D 81/058* (2013.01); *B65D 85/68* (2013.01); *B65D 2581/053* (2013.01); *B65D 2585/86* (2013.01)

(58) Field of Classification Search
CPC .. B65D 81/056; B65D 81/057; B65D 81/058; B65D 85/68; B65D 2581/053; B65D 2585/86; B65D 81/055; B65D 81/107; B65D 25/02; B65D 81/05
USPC ..... 206/586
See application file for complete search history.

(56) References Cited

U.S. PATENT DOCUMENTS 4,287,265 A * 9/1981 McKnight ..... B65D 81/056 267/141.1
4,880,214 A * 11/1989 Sukai ..... B65D 81/05 403/194
5,175,041 A * 12/1992 Webb ..... B65D 81/056 428/116
2004/0096626 A1* 5/2004 Azevedo ..... B32B 3/18 428/35.7
2008/0179216 A1* 7/2008 Kari ..... B65D 81/057 206/586
2012/0237717 A1* 9/2012 Dunn ..... B32B 29/007 428/116

FOREIGN PATENT DOCUMENTS

JP 2018-131268 A 8/2018

* cited by examiner

*Primary Examiner* — J. Gregory Pickett
*Assistant Examiner* — Jenine Pagan
(74) *Attorney, Agent, or Firm* — WORKMAN NYDEGGER

(57) ABSTRACT

Provided is a cushioning material for being put into a packing box configured for encasement of electronic equipment. The cushioning material absorbs external stress applied to the electronic equipment encased in the packing box. The cushioning material includes: a first holder including a first plate configured to face the electronic equipment when the cushioning material and the electronic equipment are encased in the packing box, and a second plate configured to face an inner wall surface of the packing box when the cushioning material and the electronic equipment are encased in the packing box; and a first cushioning block provided between the first plate and the second plate.

9 Claims, 11 Drawing Sheets

CUSHIONING MATERIAL, PACKING MATERIAL, AND PACKED GOODS

The present application is based on, and claims priority from JP Application Serial Number 2021-182458, filed Nov. 9, 2021, the disclosure of which is hereby incorporated by reference herein in its entirety.

BACKGROUND

1. Technical Field

The present disclosure relates to a cushioning material, a packing material, and packed goods.

2. Related Art

A cushioning material for being put into a packing box configured for encasement of electronic equipment so as to absorb external stress applied to the electronic equipment is known. For example, JP-A-2018-131268 discloses a technique for absorbing external stress applied to the electronic equipment by means of a cushioning material that includes two plate-like members.

However, in related art, the structure is hollow in between the two plate-like members. For this reason, in related art, it could happen that the two plate-like members come into contact with each other when the cushioning material is under external stress, resulting in failing to absorb the external stress.

SUMMARY

Provided by a certain aspect of the present disclosure is a cushioning material for being put into a packing box configured for encasement of electronic equipment, the cushioning material being configured to absorb external stress applied to the electronic equipment encased in the packing box, the cushioning material comprising: a first holder including a first plate configured to face the electronic equipment when the cushioning material and the electronic equipment are encased in the packing box, and a second plate configured to face an inner wall surface of the packing box when the cushioning material and the electronic equipment are encased in the packing box; and a first cushioning block provided between the first plate and the second plate.

Also provided by a certain aspect of the present disclosure is a packing material, comprising: a packing box configured for encasement of electronic equipment; and a cushioning material for being put into the packing box and configured to absorb external stress applied to the electronic equipment encased in the packing box, the cushioning material including a first holder including a first plate configured to face the electronic equipment when the cushioning material and the electronic equipment are encased in the packing box, and a second plate configured to face an inner wall surface of the packing box when the cushioning material and the electronic equipment are encased in the packing box; and a first cushioning block provided between the first plate and the second plate.

Also provided by a certain aspect of the present disclosure is packed goods, comprising: electronic equipment; a packing box configured for encasement of the electronic equipment; and a cushioning material for being put into the packing box and configured to absorb external stress applied to the electronic equipment encased in the packing box, the cushioning material including a first holder including a first plate configured to face the electronic equipment when the cushioning material and the electronic equipment are encased in the packing box, and a second plate configured to face an inner wall surface of the packing box when the cushioning material and the electronic equipment are encased in the packing box; and a first cushioning block provided between the first plate and the second plate.

DESCRIPTION OF EXEMPLARY EMBODIMENTS

Figure 1:
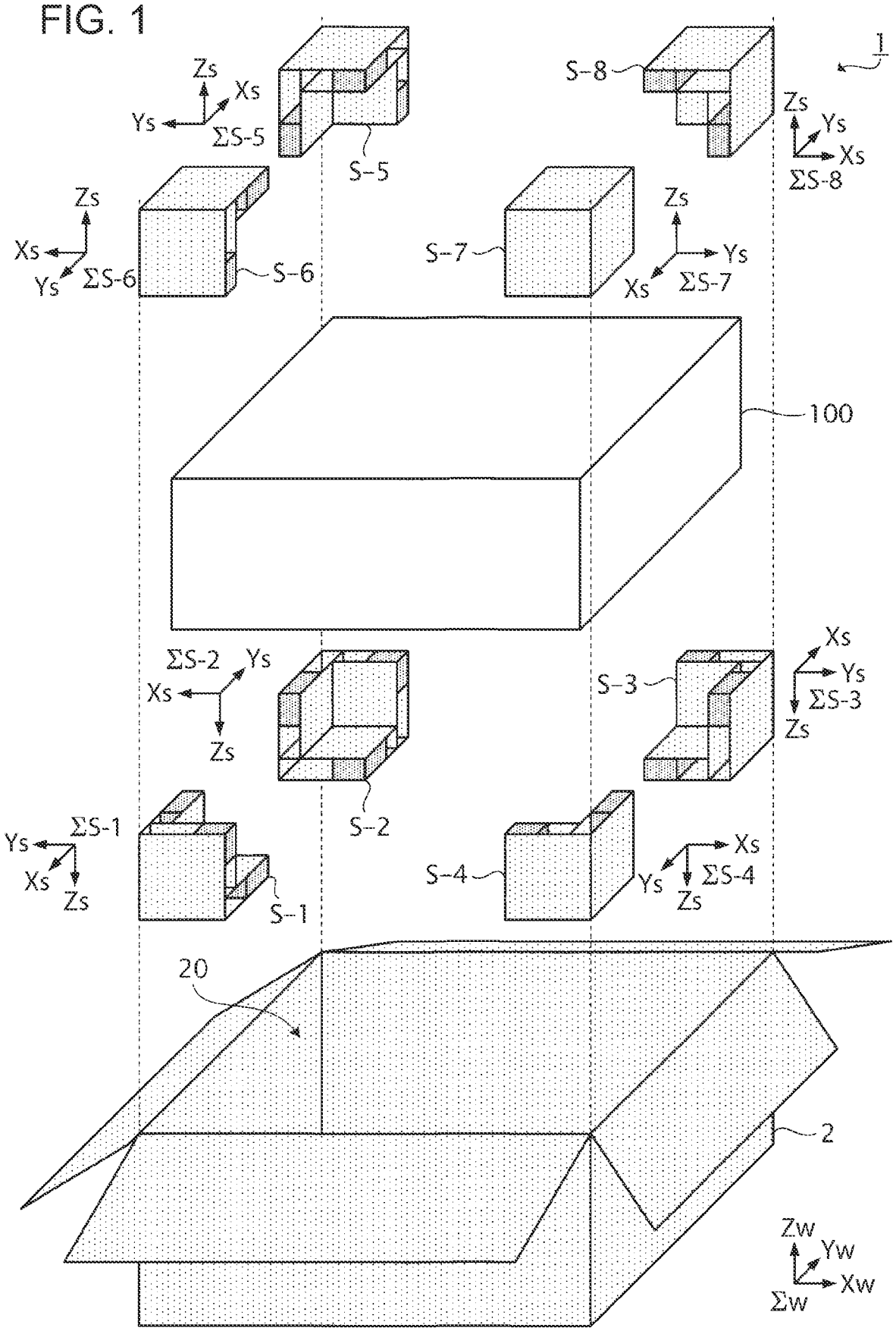
FIG. 1 is an exploded perspective view illustrating an example of a structure of a packing material according to an exemplary embodiment of the present disclosure.

With reference to the accompanying drawings, some exemplary embodiments of the present disclosure will now be explained. In the drawings, the dimensions and scales of components may be made different from those in actual implementation. Since the embodiment described below shows some preferred examples of the present disclosure, they contain various technically-preferred limitations. However, the scope of the present disclosure shall not be construed to be limited to the examples described below unless and except where the description contains an explicit mention of an intent to limit the present disclosure.

A. EXEMPLARY EMBODIMENT

With reference to FIGS. 1 to 4, an example of a structure of a packing material 1 according to a present embodiment will now be explained.

1. Packed Goods

FIG. 1 is an exploded perspective view illustrating an example of a structure of a packing material 1.

As illustrated in FIG. 1, the packing material 1 is used for encasement of electronic equipment 100. Specifically, the packing material 1 includes a packing box 2 configured for encasement of the electronic equipment 100, and includes plural pieces of cushioning material S configured to absorb external stress applied to the electronic equipment 100 encased in the packing box 2.

One example of the electronic equipment 100 is a printing apparatus such as an ink-jet printer. However, the electronic equipment 100 according to the present embodiment is not limited thereto. It may be any equipment other than a printing apparatus, for example, a television set, a refrigerator, a washing machine, a microwave, a personal computer, or the like.

A collective term "packed goods" may be hereinafter used for collectively referring to, together with the packing material 1, the electronic equipment 100 that is in an encased state by being packed using the packing material 1.

As illustrated in FIG. 1, in the present embodiment, it is assumed that the packing material 1 includes eight pieces of cushioning material S-1 to S-8. In the present embodiment, the electronic equipment 100 and the eight pieces of cushioning material S-1 to S-8 are put into the packing box 2 through an opening 20 of the packing box 2, thereby becoming encased in the packing box 2.

For easier understanding, the description below will be given with reference to a packing box coordinate system W fixed to the packing box 2. The packing box coordinate system ΣW introduced herein is a triaxial coordinate system that includes a Zw axis, which extends in a +Zw direction, an Xw axis, which extends in an +Xw direction orthogonal to the +Zw direction, and a Yw axis, which extends in a +Yw direction orthogonal to the +Zw direction and the +Xw direction. The +Zw direction is a direction from the bottom of the packing box 2 toward its opening 20. In the description below, the direction that is the opposite of the +Xw direction will be referred to as "−Xw direction", the direction that is the opposite of the +Yw direction will be referred to as "−Yw direction", and the direction that is the opposite of the +Zw direction will be referred to as "−Zw direction".

The description below will be given also with reference to a cushioning material coordinate system ΣS fixed to the cushioning material S. The cushioning material coordinate system ΣS introduced herein is a triaxial coordinate system that includes a Zs axis, which extends in a +Zs direction, an Xs axis, which extends in an +Xs direction orthogonal to the +Zs direction, and a Ys axis, which extends in a +Ys direction orthogonal to the +Zs direction and the +Xs direction. In the description below, the direction that is the opposite of the +Xs direction will be referred to as "−Xs direction", the direction that is the opposite of the +Ys direction will be referred to as "−Ys direction", and the direction that is the opposite of the +Zs direction will be referred to as "−Zs direction".

As illustrated in FIG. 1, the cushioning material S-1 is a cushioning material S that supports one lower corner portion of the electronic equipment 100 at a position on the −Zw side of the electronic equipment 100 and on the −Xw side and the −Yw side of the electronic equipment 100 when the electronic equipment 100 and the eight pieces of cushioning material S-1 to S-8 are encased in the packing box 2. The cushioning material coordinate system ΣS-1 fixed to the cushioning material S-1 is provided such that the +Zs direction is in line with the −Zw direction, the +Xs direction is in line with the −Yw direction, and the +Ys direction is in line with the −Xw direction.

The cushioning material S-2 is a cushioning material S that supports another one lower corner portion of the electronic equipment 100 at a position on the −Zw side of the electronic equipment 100 and on the −Xw side and the +Yw side of the electronic equipment 100 when the electronic equipment 100 and the eight pieces of cushioning material S-1 to S-8 are encased in the packing box 2. The cushioning material coordinate system ΣS-2 fixed to the cushioning material S-2 is provided such that the +Zs direction is in line with the −Zw direction, the +Xs direction is in line with the −Xw direction, and the +Ys direction is in line with the +Yw direction.

The cushioning material S-3 is a cushioning material S that supports another one lower corner portion of the electronic equipment 100 at a position on the −Zw side of the electronic equipment 100 and on the +Xw side and the +Yw side of the electronic equipment 100 when the electronic equipment 100 and the eight pieces of cushioning material S-1 to S-8 are encased in the packing box 2. The cushioning material coordinate system ΣS-3 fixed to the cushioning material S-3 is provided such that the +Zs direction is in line with the −Zw direction, the +Xs direction is in line with the +Yw direction, and the +Ys direction is in line with the +Xw direction.

The cushioning material S-4 is a cushioning material S that supports another one lower corner portion of the electronic equipment 100 at a position on the −Zw side of the electronic equipment 100 and on the +Xw side and the −Yw side of the electronic equipment 100 when the electronic equipment 100 and the eight pieces of cushioning material S-1 to S-8 are encased in the packing box 2. The cushioning material coordinate system ΣS-4 fixed to the cushioning material S-4 is provided such that the +Zs direction is in line with the −Zw direction, the +Xs direction is in line with the +Xw direction, and the +Ys direction is in line with the −Yw direction.

The cushioning material S-5 is a cushioning material S that supports one upper corner portion of the electronic equipment 100 at a position on the +Zw side of the electronic equipment 100 and on the −Xw side and the +Yw side of the electronic equipment 100 when the electronic equipment 100 and the eight pieces of cushioning material S-1 to S-8 are encased in the packing box 2. The cushioning material coordinate system ΣS-5 fixed to the cushioning material S-5 is provided such that the +Zs direction is in line with the +Zw direction, the +Xs direction is in line with the +Yw direction, and the +Ys direction is in line with the −Xw direction.

The cushioning material S-6 is a cushioning material S that supports another one upper corner portion of the electronic equipment 100 at a position on the +Zw side of the electronic equipment 100 and on the −Xw side and the −Yw side of the electronic equipment 100 when the electronic equipment 100 and the eight pieces of cushioning material S-1 to S-8 are encased in the packing box 2. The cushioning material coordinate system ΣS-6 fixed to the cushioning material S-6 is provided such that the +Zs direction is in line with the +Zw direction, the +Xs direction is in line with the −Xw direction, and the +Ys direction is in line with the −Yw direction.

The cushioning material S-7 is a cushioning material S that supports another one upper corner portion of the electronic equipment 100 at a position on the +Zw side of the electronic equipment 100 and on the +Xw side and the −Yw side of the electronic equipment 100 when the electronic equipment 100 and the eight pieces of cushioning material S-1 to S-8 are encased in the packing box 2. The cushioning material coordinate system ΣS-7 fixed to the cushioning material S-7 is provided such that the +Zs direction is in line with the +Zw direction, the +Xs direction is in line with the −Yw direction, and the +Ys direction is in line with the +Xw direction.

The cushioning material S-8 is a cushioning material S that supports another one upper corner portion of the electronic equipment 100 at a position on the +Zw side of the electronic equipment 100 and on the +Xw side and the +Yw side of the electronic equipment 100 when the electronic equipment 100 and the eight pieces of cushioning material S-1 to S-8 are encased in the packing box 2. The cushioning material coordinate system ΣS-8 fixed to the cushioning material S-8 is provided such that the +Zs direction is in line with the +Zw direction, the +Xs direction is in line with the +Xw direction, and the +Ys direction is in line with the +Yw direction.

2. Cushioning Material

Figure 2:
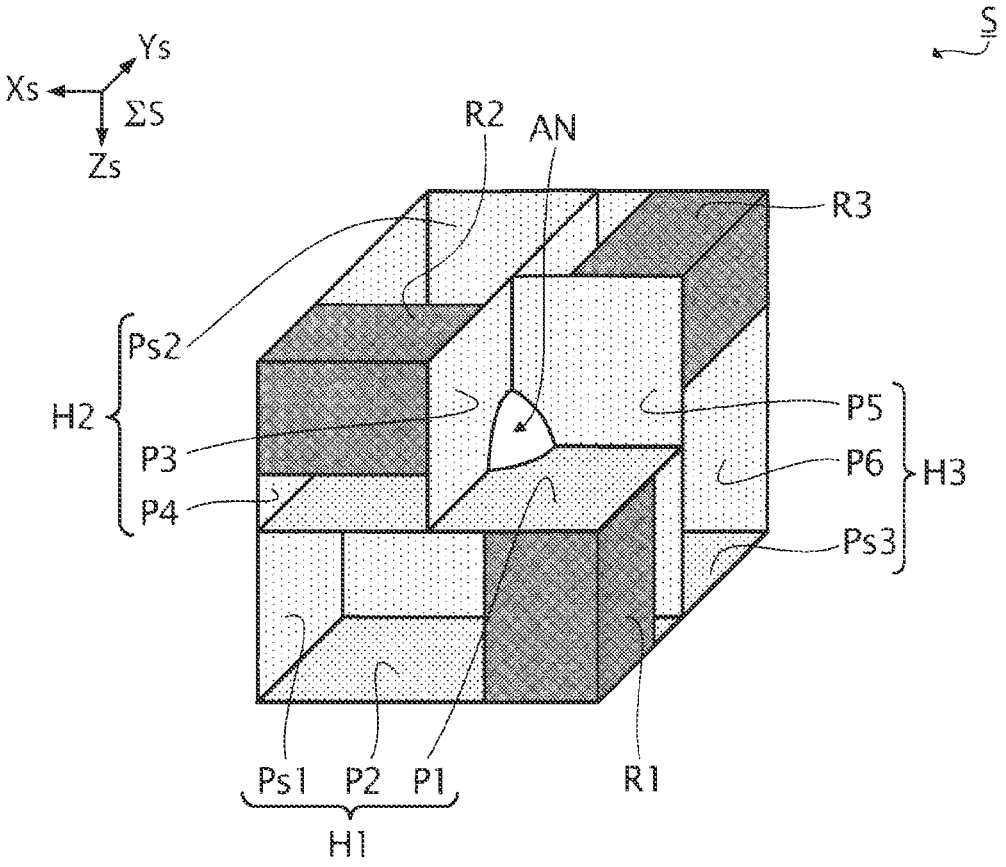
FIG. 2 is a perspective view illustrating an example of a structure of a cushioning material S.

FIG. 2 is a perspective view illustrating an example of a structure of the cushioning material S.

As illustrated in FIG. 2, the cushioning material S includes a plurality of cushioning blocks R for absorbing external stress applied to the electronic equipment 100 and a plurality of holders H for holding the plurality of cushioning blocks R respectively. In the present embodiment, a case where the cushioning material S includes three holders H1, H2, and H3 is assumed as an example.

The holder H1 includes a holder plate P1, a holder plate P2, and a link plate Ps1. The holder plate P1 is disposed such that a line normal to it goes in the +Zs direction. The holder plate P2 constitutes a part of the +Zs-side face of the cushioning material S and is disposed at a +Zs-side position with respect to the holder plate P1 such that a line normal to it goes in the +Zs direction. The link plate Ps1 links the holder plate P1 and the holder plate P2 to each other.

The holder H2 includes a holder plate P3, a holder plate P4, and a link plate Ps2. The holder plate P3 is disposed such that a line normal to it goes in the +Xs direction. The holder plate P4 constitutes a part of the +Xs-side face of the cushioning material S and is disposed at a +Xs-side position with respect to the holder plate P3 such that a line normal to it goes in the +Xs direction. The link plate Ps2 links the holder plate P3 and the holder plate P4 to each other.

The holder H3 includes a holder plate P5, a holder plate P6, and a link plate Ps3. The holder plate P5 is disposed such that a line normal to it goes in the +Ys direction. The holder plate P6 constitutes a part of the +Ys-side face of the cushioning material S and is disposed at a +Ys-side position with respect to the holder plate P5 such that a line normal to it goes in the +Ys direction. The link plate Ps3 links the holder plate P5 and the holder plate P6 to each other.

The holder plates P1 to P6 and the link plates Ps1, Ps2, and Ps3 may be hereinafter collectively referred to as "holder plate(s) P". In the present embodiment, a case where each of the plurality of holder plates P constituting the holders H is made of corrugated cardboard is assumed as an example.

As illustrated in FIG. 2, in the present embodiment, it is assumed that the cushioning material S has three cushioning blocks, specifically, a cushioning block R1 held by the holder H1, a cushioning block R2 held by the holder H2, and a cushioning block R3 held by the holder H3.

The cushioning block R1 is held by the holder H1 between the holder plate P1 and the holder plate P2. In the present embodiment, a case where the cushioning block R1 is held by the holder H1 by bonding the −Zs-side end of the cushioning block R1 to the holder plate P1 by means of adhesive and by bonding the +Zs-side end of the cushioning block R1 to the holder plate P2 by means of adhesive is assumed as an example.

The cushioning block R2 is held by the holder H2 between the holder plate P3 and the holder plate P4. In the present embodiment, a case where the cushioning block R2 is held by the holder H2 by bonding the −Xs-side end of the cushioning block R2 to the holder plate P3 by means of adhesive and by bonding the +Xs-side end of the cushioning block R2 to the holder plate P4 by means of adhesive is assumed as an example.

The cushioning block R3 is held by the holder H3 between the holder plate P5 and the holder plate P6. In the present embodiment, a case where the cushioning block R3 is held by the holder H3 by bonding the −Ys-side end of the cushioning block R3 to the holder plate P5 by means of adhesive and by bonding the +Ys-side end of the cushioning block R3 to the holder plate P6 by means of adhesive is assumed as an example.

In the present embodiment, it is assumed that the cushioning block R is made of a material having lower elasticity than styrene foam.

In the present embodiment, the following case is assumed as an example: fibers contained in a matter/material are obtained by defibrating the matter/material such as paper, clothes, or the like containing various kinds of fibers such as animal-based fibers, plant-based fibers, chemical fibers, or the like, and then the obtained fibers are processed, thereby forming the cushioning blocks R. More specifically, in the present embodiment, it is assumed that fibers contained in paper are obtained by defibrating the paper, and then the obtained fibers are hardened, thereby forming the cushioning blocks R.

As described above, in the present embodiment, the cushioning blocks R are produced by going through a process of obtaining fibers from a fiber-containing matter/material such as paper, clothes, or the like. That is, in the present embodiment, when a fiber-containing matter/material such as paper, clothes, or the like is thrown away, it is possible to produce the cushioning blocks R by recycling this matter/material. Therefore, the scheme of the present embodiment makes it possible to reduce environmental burdens pertinent to production and disposal of the cushioning blocks R.

In the present embodiment, the holder plate P1, the holder plate P3, and the holder plate P5 face the electronic equipment 100 when the cushioning material S and the electronic equipment 100 are encased in the packing box 2. A cavity AN is formed in the holder plate P1, the holder plate P3, and the holder plate P5 at a position that corresponds to each corner of the electronic equipment 100 when the cushioning material S and the electronic equipment 100 are encased in the packing box 2. The holder plate P2, the holder plate P4, and the holder plate P6 face inner wall surfaces of the packing box 2 respectively when the cushioning material S and the electronic equipment 100 are encased in the packing box 2.

In the present embodiment, the holder H1 is an example of "a first holder", and the holder H2 is an example of "a second holder". In the present embodiment, the holder plate P1 is an example of "a first plate", the holder plate P2 is an example of "a second plate", the holder plate P3 is an example of "a third plate", and the holder plate P4 is an example of "a fourth plate". In the present embodiment, the cushioning block R1 is an example of "a first cushioning block", and the cushioning block R2 is an example of "a second cushioning block". In the present embodiment, the +Zs direction is an example of "a first direction", and the +Xs direction is an example of "a second direction".

Figure 3:
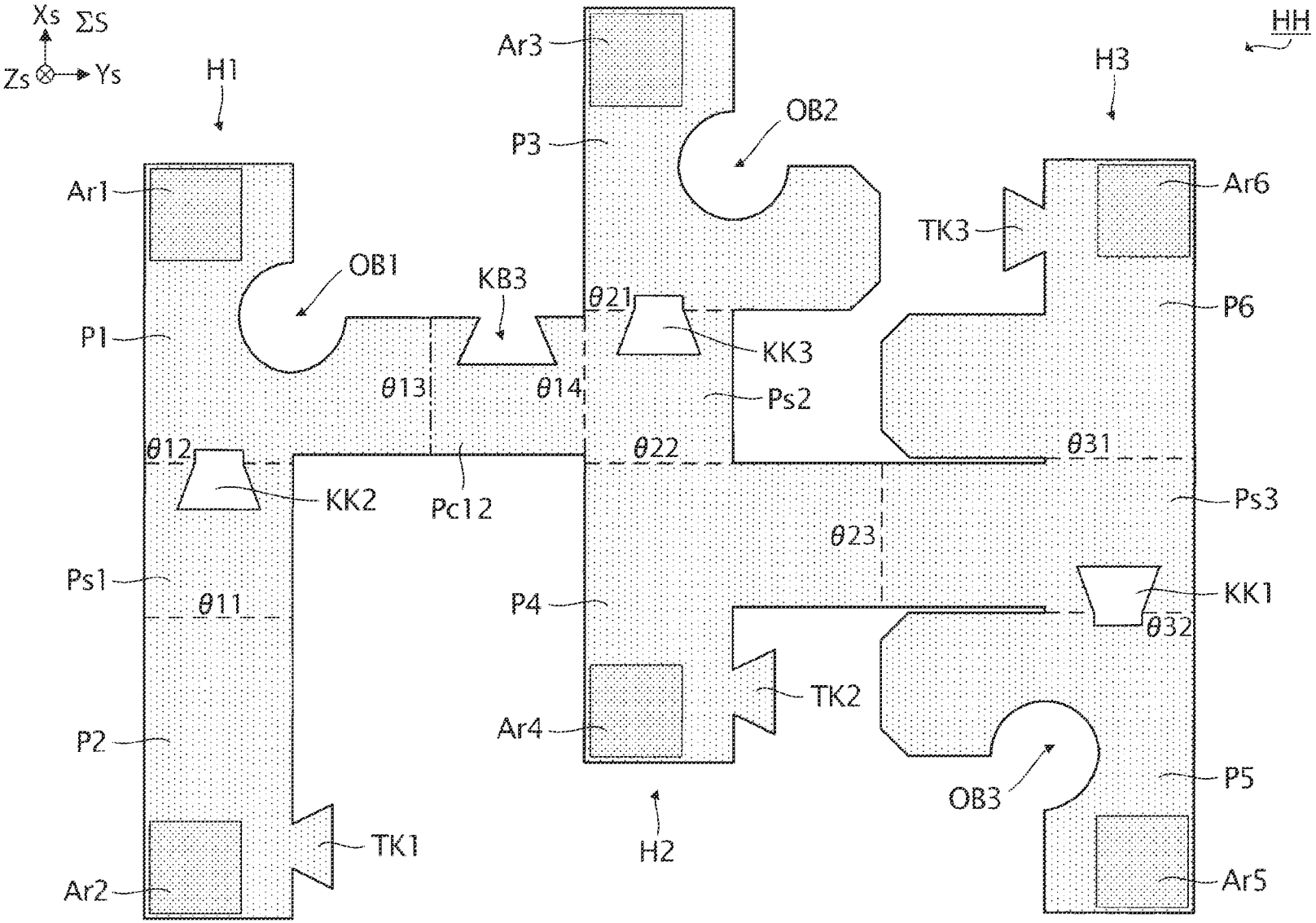
FIG. 3 is a plan view illustrating an example of a shape of a flat plate-like member HH.

FIG. 3 is a plan view illustrating an example of a shape of a flat plate-like member HH.

In the present embodiment, for example, it is assumed that the holders H1, H2, and H3 of the cushioning material S are formed by folding a single flat plate-like member HH illustrated as an example in FIG. 3 along fold lines θ11 to θ32 illustrated as an example in FIG. 3. As described earlier, in the present embodiment, a case where the flat plate-like member HH is made of corrugated cardboard is assumed as an example.

As illustrated in FIG. 3, besides the holder plates P1 to P6 and the link plates Ps1, Ps2, and Ps3, which have been described with reference to FIG. 2, the flat plate-like member HH includes a link plate Pc12. In FIG. 3, the following case is assumed as an example: a case where the cushioning material coordinate system ΣS is a coordinate system fixed to the holder plate P2 and where the flat plate-like member HH is obtained by developing (flattening) the holders H1, H2, and H3 in a state in which the cushioning material coordinate system ΣS is fixed to the holder plate P2.

As described above, the holder H1 includes the holder plate P1, the holder plate P2, and the link plate Ps1. The holder H1 further includes the link plate Pc12. As illustrated in FIG. 3, the holder plate P2 is continuous to the link plate Ps1 across the fold line θ11, the link plate Ps1 is continuous to the holder plate P1 across the fold line θ12, and the holder plate P1 is continuous to the link plate Pc12 across the fold line θ13.

As described above, the holder H2 includes the holder plate P3, the holder plate P4, and the link plate Ps2. As illustrated in FIG. 3, the holder plate P3 is continuous to the link plate Ps2 across the fold line θ21, and the link plate Ps2 is continuous to the holder plate P4 across the fold line θ22.

As described above, the holder H3 includes the holder plate P5, the holder plate P6, and the link plate Ps3. As illustrated in FIG. 3, the holder plate P5 is continuous to the link plate Ps3 across the fold line θ32, and the link plate Ps3 is continuous to the holder plate P6 across the fold line θ31.

In the present embodiment, the fold line θ13 is a mountain fold line, and those other than the fold line θ13 are valley fold lines. The term "valley fold line" as used herein means a fold line at which the flat plate-like member HH is folded along this fold line toward the near side in FIG. 3, that is, toward the +Zs direction, for the two plate members adjoining each other across this fold line in a process of forming the holders H1, H2, and H3 from the flat plate-like member HH. The term "mountain fold line" as used herein means a fold line at which the flat plate-like member HH is folded along this fold line toward the opposite side in FIG. 3, that is, toward the −Zs direction, for the two plate members adjoining each other across this fold line in a process of forming the holders H1, H2, and H3 from the flat plate-like member HH.

As illustrated in FIG. 3, the holder plate P1 has an arched recessed portion OB1, the holder plate P2 has a protruding portion TK1, the link plate Pc12 has a recessed portion KB3, and there is an opening KK2 on the fold line θ12, which is the border between the holder plate P1 and the link plate Ps1. The holder plate P3 has an arched recessed portion OB2, the holder plate P4 has a protruding portion TK2, and there is an opening KK3 on the fold line θ21, which is the border between the holder plate P3 and the link plate Ps2. The holder plate P5 has an arched recessed portion OB3, the holder plate P6 has a protruding portion TK3, and there is an opening KK1 on the fold line θ32, which is the border between the holder plate P5 and the link plate Ps3.

The flat plate-like member HH is folded along the fold line θ13 in a mountain-folding manner and along the fold lines other than the fold line θ13, specifically, along the fold lines θ11, θ12, θ14, θ21, θ22, θ23, θ31, and θ32, in a valley-folding manner, thereby fitting the protruding portion TK1 into the opening KK1, fitting the protruding portion TK2 into the opening KK2, and fitting the protruding portion TK3 into the opening KK3 and the recessed portion KB3. In addition, the cavity AN is formed of the recessed portions OB1, OB2, OB3 by folding the flat plate-like member HH along the fold lines θ11 to θ32.

When the flat plate-like member HH is folded along the fold lines θ11 to θ32, one end of the cushioning block R1 is bonded to an area Ar1 of the holder plate P1, and the other end of the cushioning block R1 is bonded to an area Ar2 of the holder plate P2, thereby holding the cushioning block R1 by the holder H1. In addition, when the flat plate-like member HH is folded along the fold lines θ11 to θ32, one end of the cushioning block R2 is bonded to an area Ar3 of the holder plate P3, and the other end of the cushioning block R2 is bonded to an area Ar4 of the holder plate P4, thereby holding the cushioning block R2 by the holder H2. In addition, when the flat plate-like member HH is folded along the fold lines θ11 to θ32, one end of the cushioning block R3 is bonded to an area Ar5 of the holder plate P5, and the other end of the cushioning block R3 is bonded to an area Ar6 of the holder plate P6, thereby holding the cushioning block R3 by the holder H3.

Figure 4:
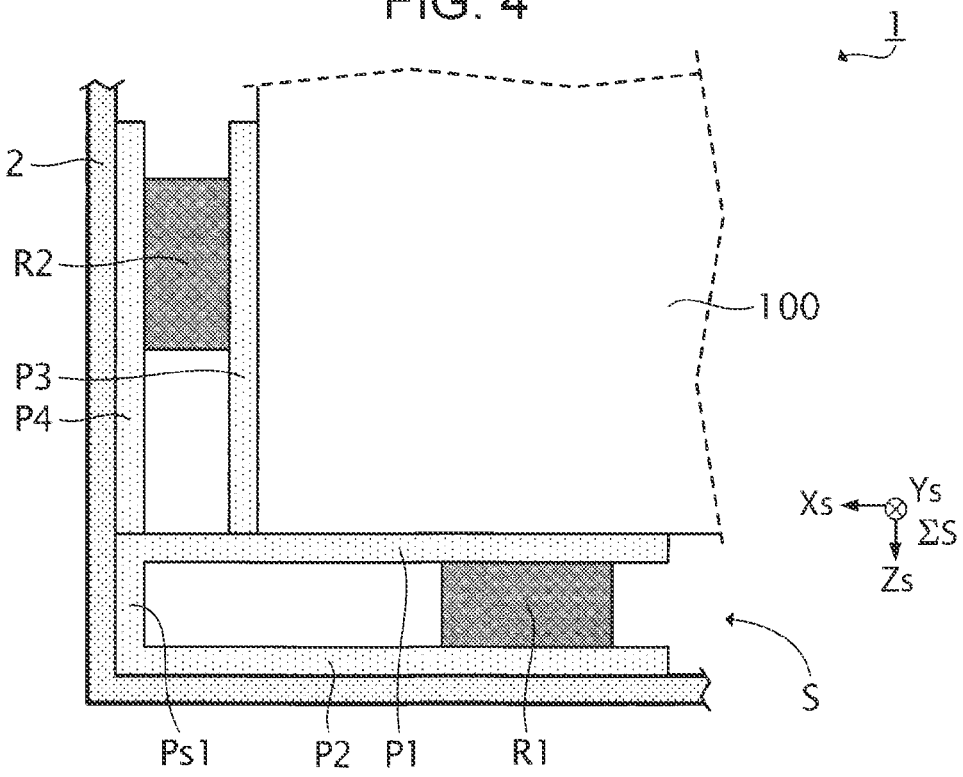
FIG. 4 is a cross-sectional view illustrating an example of a structure of the cushioning material S.

FIG. 4 is a cross-sectional view illustrating an example of a cross section of the cushioning material S taken along a plane perpendicular to the +Ys direction and passing through the cushioning block R1 and the cushioning block R2.

As illustrated in FIG. 4, in the cushioning material S according to the present embodiment, the −Zs-side end of the cushioning block R1 is bonded to the holder plate P1, the +Zs-side end of the cushioning block R1 is bonded to the holder plate P2, and the holder plate P1 and the holder plate P2 are linked to each other by the link plate Ps1.

For the purpose of explaining one of the effects of the present embodiment, a cushioning material SW of a packing material 1W according to a referential example will now be considered.

Figure 5:
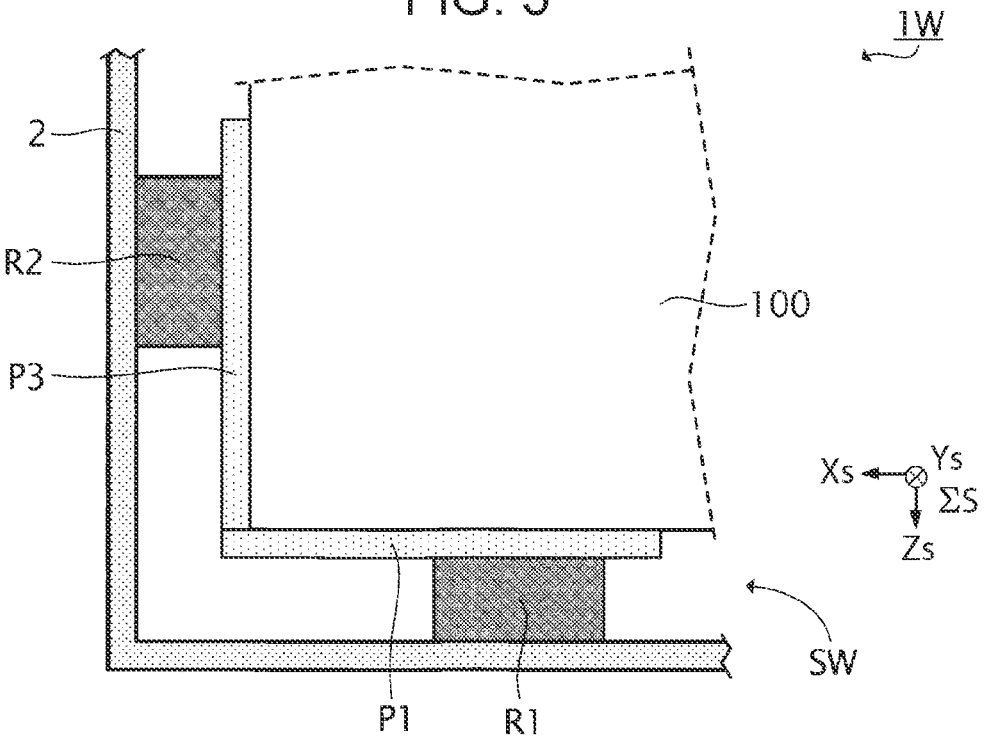
FIG. 5 is a cross-sectional view illustrating an example of a structure of a cushioning material SW according to a referential example.

FIG. 5 is a cross-sectional view illustrating an example of a cross section of a cushioning material SW of a packing material 1W according to a referential example. The packing material 1W is different from the packing material 1 according to the exemplary embodiment in that it includes plural pieces of cushioning material SW in place of the plural pieces of cushioning material S.

As illustrated in FIG. 5, the cushioning material SW according to the referential example is different from the cushioning material S according to the exemplary embodiment in that the holder H1 does not include the holder plate P2 and the link plate Ps1 and in that the holder H2 does not include the holder plate P4 and the link plate Ps2. That is, in the packing material 1W according to the referential example, the −Zs-side end of the cushioning block R1 is bonded to the holder plate P1, the +Zs-side end of the cushioning block R1 is in contact with an inner wall surface of the packing box 2.

For example, when external stress is applied to the cushioning block R1 of the cushioning material SW according to the referential example via the packing box 2 or the electronic equipment 100, in some instances positional displacement of one end of the cushioning block R1 could occur.

Then, when the positional displacement of the one end of the cushioning block R1 occurs due to the external stress applied to the cushioning block R1 of the cushioning material SW according to the referential example via the packing box 2 or the electronic equipment 100, it could happen that the other end of the cushioning block R1 fails to follow the positional displacement of the one end of the cushioning block R1. If the other end of the cushioning block R1 fails to follow the positional displacement of the one end of the cushioning block R1, it follows that the other end of the cushioning block R1 is located relatively on the +Xs side or on the −Xs side with respect to the one end of the cushioning block R1. For this reason, when external stress is applied to the cushioning block R1 of the cushioning material SW according to the referential example via the packing box 2 or the electronic equipment 100, there is a possibility that the cushioning block R1 might come off the holder plate P1 or the packing box 2. In the cushioning material SW according to the referential example, also for the cushioning blocks R other than the cushioning block R1, similarly to the cushioning block R1, there is a possibility of coming off the holder plate P1 or the packing box 2 due to external stress applied thereto via the packing box 2 or the electronic equipment 100.

By contrast, in the cushioning material S according to the present embodiment, as described earlier, one end of the cushioning block R1 is bonded to the holder plate P1, the other end of the cushioning block R1 is bonded to the holder plate P2, and the holder plate P1 and the holder plate P2 are linked to each other by the link plate Ps1.

For this reason, in the present embodiment, even when the positional displacement of the one end of the cushioning block R1 occurs due to external stress applied to the cushioning block R1 via the packing box 2 or the electronic equipment 100, the other end of the cushioning block R1 follows the positional displacement of the one end of the cushioning block R1 through the intermediary of the holder plate P1, the link plate Ps1, and the holder plate P2 and thus becomes displaced. Therefore, the present embodiment makes it possible to reduce the risk of coming off of the cushioning block R1 from the holder plate P1 or the holder plate P2, to which the cushioning block R1 is bonded, due to the external stress applied to the packing box 2 or the electronic equipment 100, as compared with the referential example. Similarly, also for the cushioning blocks R other than the cushioning block R1, the present embodiment makes it possible to reduce the risk of coming off of this cushioning block R from the holder H, to which this cushioning block R is bonded, due to the external stress applied to the packing box 2 or the electronic equipment 100, as compared with the referential example.

In the present embodiment, the cushioning block R1 is provided between the holder plate P1 and the holder plate P2. Therefore, as compared with a structure in which the cushioning block R1 is not provided between the holder plate P1 and the holder plate P2, the present embodiment makes it possible to absorb the external stress applied to the electronic equipment 100 more reliably. That is, in the present embodiment, the cushioning block R is provided between the plurality of holder plates P of the holder H. Therefore, as compared with a structure in which the cushioning block R is not provided between the plurality of holder plates P of the holder H, the present embodiment makes it possible to absorb the external stress applied to the electronic equipment 100 more reliably.

In the present embodiment, the link plate Ps1 is provided at an area different from an area where the electronic equipment 100 and the packing box 2 overlap each other when the packing material 1 is viewed in the −Zs direction. More specifically, in the present embodiment, the link plate Ps1 is provided relatively on the +Xs side with respect to the electronic equipment 100 when the packing material 1 is viewed in the −Zs direction. Therefore, in the present embodiment, it is possible to absorb, by the cushioning block R1, external stress applied to the electronic equipment 100 and to prevent the link plate Ps1 from having an influence on the absorption of the external stress applied to the electronic equipment 100. Therefore, in the present embodiment, in order to achieve efficient absorption of the external stress by the cushioning material S, just taking the absorption of the external stress applied to the electronic equipment 100 by the cushioning block R1 into consideration suffices. This makes the design of the cushioning material S easier, as compared with a structure in which the external stress applied to the electronic equipment 100 is absorbed both by the link plate Ps1 and by the cushioning block R1. Similarly, in the present embodiment, the link plate Ps2 is provided relatively on the +Ys side with respect to the electronic equipment 100, the link plate Ps3 is provided relatively on the +Zs side with respect to the electronic equipment 100, and, therefore, the design of the cushioning material S is easier, as compared with a structure in which the external stress applied to the electronic equipment 100 is absorbed both by the link plate Ps and by the cushioning block R.

3. Conclusion of First Embodiment

As described above, the cushioning material S according to the present embodiment is a cushioning material for being put into the packing box 2 configured for encasement of the electronic equipment 100. The cushioning material is configured to absorb external stress applied to the electronic equipment 100 encased in the packing box 2. The cushioning material comprises the holder H1 and the cushioning block R1. The holder H1 includes the holder plate P1 and the holder plate P2. The holder plate P1 is configured to face the electronic equipment 100 when the cushioning material S and the electronic equipment 100 are encased in the packing box 2. The holder plate P2 is configured to face an inner wall surface of the packing box 2 when the cushioning material S and the electronic equipment 100 are encased in the packing box 2. The cushioning block R1 is provided between the holder plate P1 and the holder plate P2.

Therefore, as compared with a structure in which the cushioning block R1 is not provided between the holder plate P1 and the holder plate P2, the present embodiment makes it possible to absorb the external stress applied to the electronic equipment 100 more reliably.

The cushioning material S according to the present embodiment further comprises the holder H2 and the cushioning block R2. The holder H2 includes the holder plate P3 and the holder plate P4. The holder plate P3 is configured to face the electronic equipment 100 when the cushioning material S and the electronic equipment 100 are encased in the packing box 2. The holder plate P4 is configured to face an inner wall surface of the packing box 2 when the cushioning material S and the electronic equipment 100 are encased in the packing box 2. The cushioning block R2 is provided between the holder plate P3 and the holder plate P4. The cushioning block R1 extends in the +Zs direction going from the holder plate P1 toward the holder plate P2. The cushioning block R2 extends in the +Xs direction going from the holder plate P3 toward the holder plate P4. The holder H1 and the holder H2 are made of a single flat plate-like member HH.

Therefore, the present embodiment makes it possible to make parts management needed for the manufacturing of the cushioning material S simpler, as compared with a case where the cushioning material S is made up of a plurality of members. Moreover, the present embodiment makes it possible to make the management of waste produced at the time of disposal of the cushioning material S simpler, as compared with a case where the cushioning material S is made up of a plurality of members.

In the cushioning material S according to the present embodiment, the cavity AN is formed in the holder plate P1 and the holder plate P3 at a position that corresponds to one of a plurality of corners of the electronic equipment 100 when the cushioning material S and the electronic equipment 100 are encased in the packing box 2. More specifically, in the cushioning material S according to the present embodiment, the recessed portion OB1 is provided in the holder plate P1, and the recessed portion OB2 is provided in the holder plate P3, such that the cavity AN will be formed at a position that corresponds to one of a plurality of corners of the electronic equipment 100 when the cushioning material S and the electronic equipment 100 are encased in the packing box 2.

Therefore, the present embodiment makes it possible to reduce the risk of damage to the cushioning material S arising from pressure applied to the cushioning material S from the corner of the electronic equipment 100, as compared with a structure in which the cavity AN is not provided in the cushioning material S.

Moreover, the present embodiment makes it possible to reduce the risk of damage, which could be caused by the positional displacement of the holder plate P1 in the +Zs direction or the −Zs direction due to pressure applied to the holder plate P1 from the electronic equipment 100 or the cushioning block R1, to the holder plate P1 or the holder plate P3 at the contact portion of the holder plate P1 and the holder plate P3, as compared with a structure in which the cavity AN is not provided in the cushioning material S. Furthermore, the present embodiment makes it possible to reduce the risk of damage, which could be caused by the positional displacement of the holder plate P3 in the +Xs direction or the −Xs direction due to pressure applied to the holder plate P3 from the electronic equipment 100 or the cushioning block R2, to the holder plate P1 or the holder plate P3 at the contact portion of the holder plate P1 and the holder plate P3, as compared with a structure in which the cavity AN is not provided in the cushioning material S.

B. MODIFICATION EXAMPLES

The exemplary embodiment described above can be modified in various ways. Some specific examples of modification are described below. Any two or more modification examples selected from among the examples described below may be combined as long as they are not contradictory to each other or one another. In each modification example described below, the same reference numerals as those used in the description and illustration of the foregoing embodiment will be assigned to elements that are equivalent to those in the foregoing embodiment in terms of operation and/or function, and a detailed explanation of them is omitted.

Modification Example 1

In the exemplary embodiment described above, the cushioning block R is fixed to the holder H by means of adhesive. However, the scope of the present disclosure is not limited to such an exemplary structure. The cushioning block R may be fixed to the holder H without using any adhesive.

Figure 6:
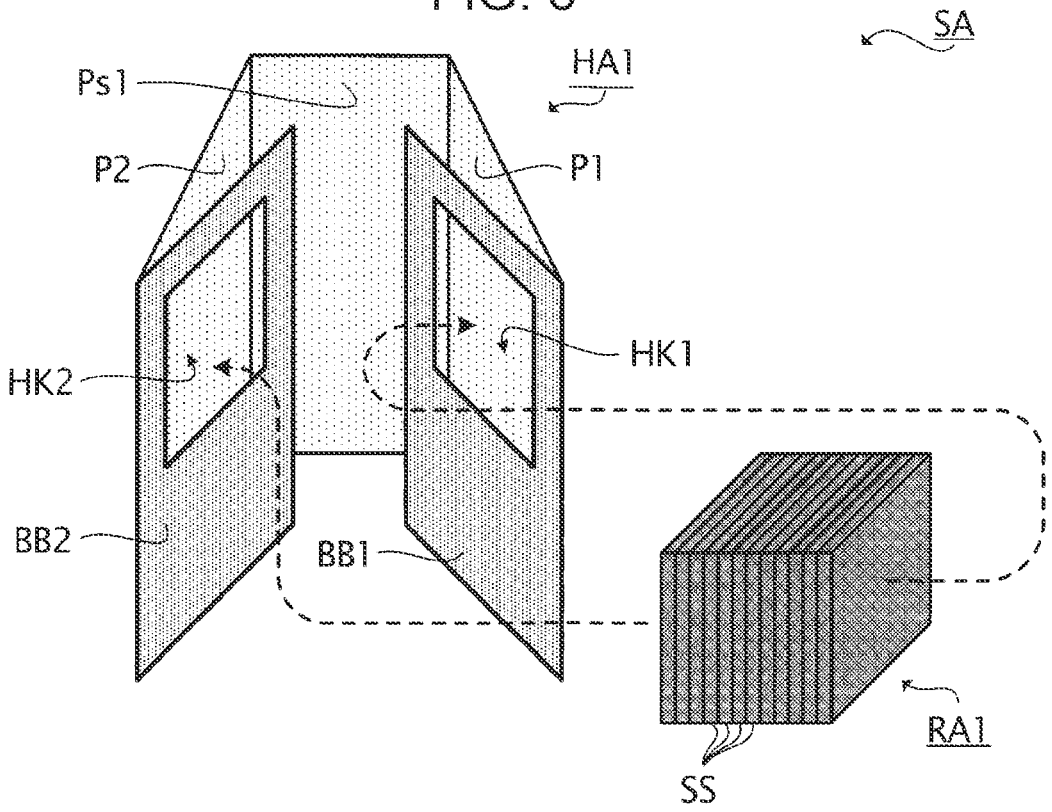
FIG. 6 is an exploded perspective view illustrating an example of a structure of a cushioning material SA according to a modification example 1 of the present disclosure.

FIG. 6 is an exploded perspective view illustrating an example of a structure of a cushioning material SA according to the present modification example.

The cushioning material SA is different from the cushioning material S according to the exemplary embodiment in that it includes a plurality of holders HA in place of the plurality of holders H and in that it includes a plurality of cushioning blocks RA in place of the plurality of cushioning blocks R. More specifically, the cushioning material SA is different from the cushioning material S according to the exemplary embodiment in that it includes three holders HA1, HA2, and HA3 in place of the three holders H1, H2, and H3 and in that it includes three cushioning blocks RA1, RA2, and RA3 in place of the three cushioning blocks R1, R2, and R3.

The holder HA is different from the holder H according to the exemplary embodiment in that it includes two arrangement plates BB between two holder plates P of the holder HA. The arrangement plate BB has an opening HK for insertion of an end portion of the cushioning block RA.

One end of the cushioning block RA is inserted into the opening HK provided in one of the two arrangement plates BB disposed between the two holder plates P of the holder HA. The other end of the cushioning block RA is inserted into the opening HK provided in the other arrangement plate BB. By this means, the cushioning block RA is fixed between the two holder plates P of the holder HA due to a frictional force produced between the opening HK provided in the one of the two arrangement plates BB, which are disposed between the two holder plates P of the holder HA, and the one end of the cushioning block RA, and due to a frictional force produced between the opening HK provided in the other arrangement plate BB and the other end of the cushioning block RA.

For example, as illustrated in FIG. 6, the holder HA1 includes an arrangement plate BB1 continuous at one end to the holder plate P1 and disposed between the holder plate P1 and the holder plate P2, and an arrangement plate BB2 continuous at one end to the holder plate P2 and disposed between the holder plate P1 and the holder plate P2, and more particularly, between the arrangement plate BB1 and the holder plate P2. The arrangement plate BB1 has an opening HK1 for insertion of one end of the cushioning block RA1. The arrangement plate BB2 has an opening HK2 for insertion of the other end of the cushioning block RA1. The one end of the cushioning block RA1 is inserted into the opening HK1. The other end of the cushioning block RA1 is inserted into the opening HK2. By this means, the cushioning block RA1 is fixed between the holder plate P1 and the holder plate P2 by the arrangement plate BB1 and the arrangement plate BB2.

The cushioning block RA is comprised of a plurality of cushioning sheets SS "stacked" in a direction going from the one end toward the other end of the cushioning block RA. Therefore, arranging the cushioning block RA between the two holder plates P of the holder HA makes it possible to absorb external stress applied to the holder HA effectively between the two holder plates P of the holder HA.

Figure 7:
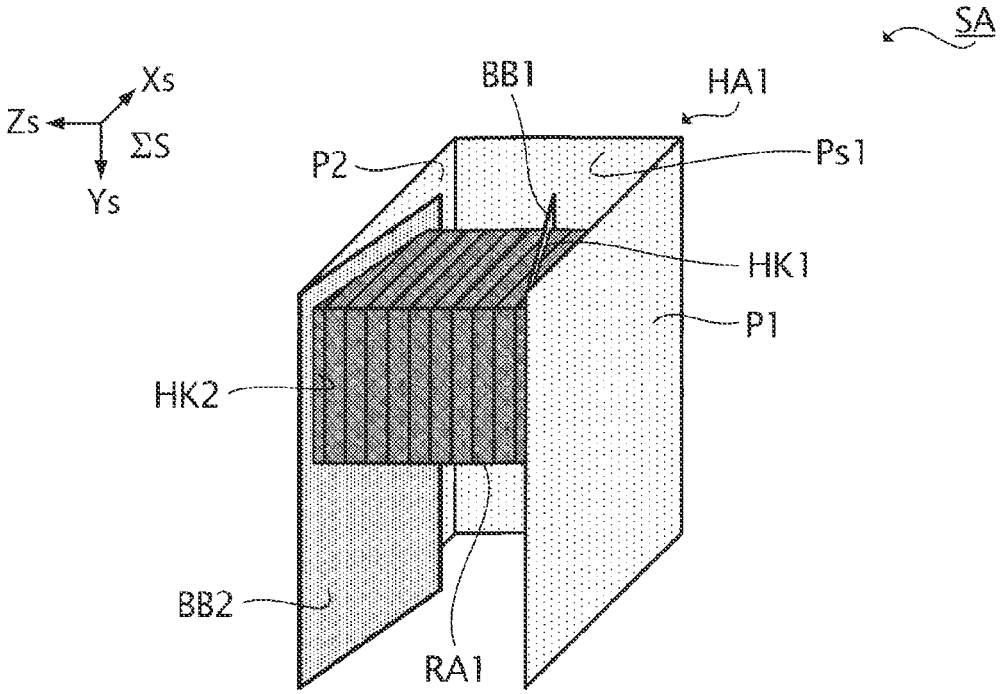
FIG. 7 is a perspective view illustrating an example of the structure of the cushioning material SA.

For example, as illustrated in FIG. 7, the cushioning block RA1 is comprised of a plurality of cushioning sheets SS stacked in the +Zs direction going from the holder plate P1 toward the holder plate P2. Therefore, the holder HA1 is able to absorb +Zs-directional external stress applied to the holder HA1 and −Zs-directional external stress applied to the holder HA1 effectively by means of the cushioning block RA1.

As explained above, in the present modification example, the cushioning block RA is mounted on the holder HA without using any adhesive. Therefore, the present modification example makes it possible to make the burden of detaching the cushioning block RA from the holder HA lighter when the cushioning material SA is taken apart, as compared with a structure in which the cushioning block RA is mounted on the holder HA by means of adhesive. Moreover, the present modification example realizes easy perfect removal of the cushioning block RA from the holder HA when the cushioning material SA is taken apart. Therefore, the present modification example makes it possible to make the recyclability of the cushioning material SA higher than that of the structure in which the cushioning block RA is mounted on the holder HA by means of adhesive.

In the cushioning material SA according to the present modification example, the cushioning block RA1 includes the plurality of cushioning sheets SS stacked in the +Zs direction going from the holder plate P1 toward the holder plate P2.

Therefore, the present modification example makes it possible to absorb +Zs-directional external stress applied to the holder plate P1 or the holder plate P2 and −Zs-directional external stress applied thereto more effectively, as compared with a structure in which the cushioning material SA does not include the cushioning block RA1.

In the cushioning material SA according to the present modification example, the holder HA1 includes the arrangement plate BB1 continuous at one end to the holder plate P1 and disposed between the holder plate P1 and the holder plate P2, and the arrangement plate BB2 continuous at one end to the holder plate P2 and disposed between the holder plate P1 and the holder plate P2. In addition, one end of the cushioning block RA1 is inserted into the opening HK1 provided in the arrangement plate BB1, and the other end of the cushioning block RA1 is inserted into the opening HK2 provided in the arrangement plate BB2.

Therefore, the present modification example makes it possible to fix the cushioning block RA1 between the holder plate P1 and the holder plate P2 of the holder HA1 by utilizing a frictional force produced between the one end of the cushioning block RA1 and the opening HK1 and a frictional force produced between the other end of the cushioning block RA1 and the opening HK2.

In the present modification example, the cushioning block RA is comprised of a plurality of cushioning sheets SS stacked in a direction going from one toward the other of two holder plates P between which this cushioning block RA is held. However, the scope of the present disclosure is not limited to such an exemplary structure. The cushioning block RA may be comprised of a plurality of cushioning sheets SS stacked in a direction intersecting with the direction going from one toward the other of two holder plates P between which this cushioning block RA is held.

Though the cushioning block RA is mounted on the holder HA by utilizing frictional forces without using any adhesive in the present modification example, the scope of the present disclosure is not limited to such an exemplary structure. For example, the cushioning block RA may be mounted on the holder HA more firmly by using adhesive in addition to frictional forces.

Modification Example 2

In the exemplary embodiment and the modification example 1 described above, a case where the plurality of holders H of the cushioning material S are made of a single flat plate-like member HH has been taken as an example. However, the scope of the present disclosure is not limited to such an exemplary structure. The cushioning material S may be comprised of a plurality of members.

Figure 8:
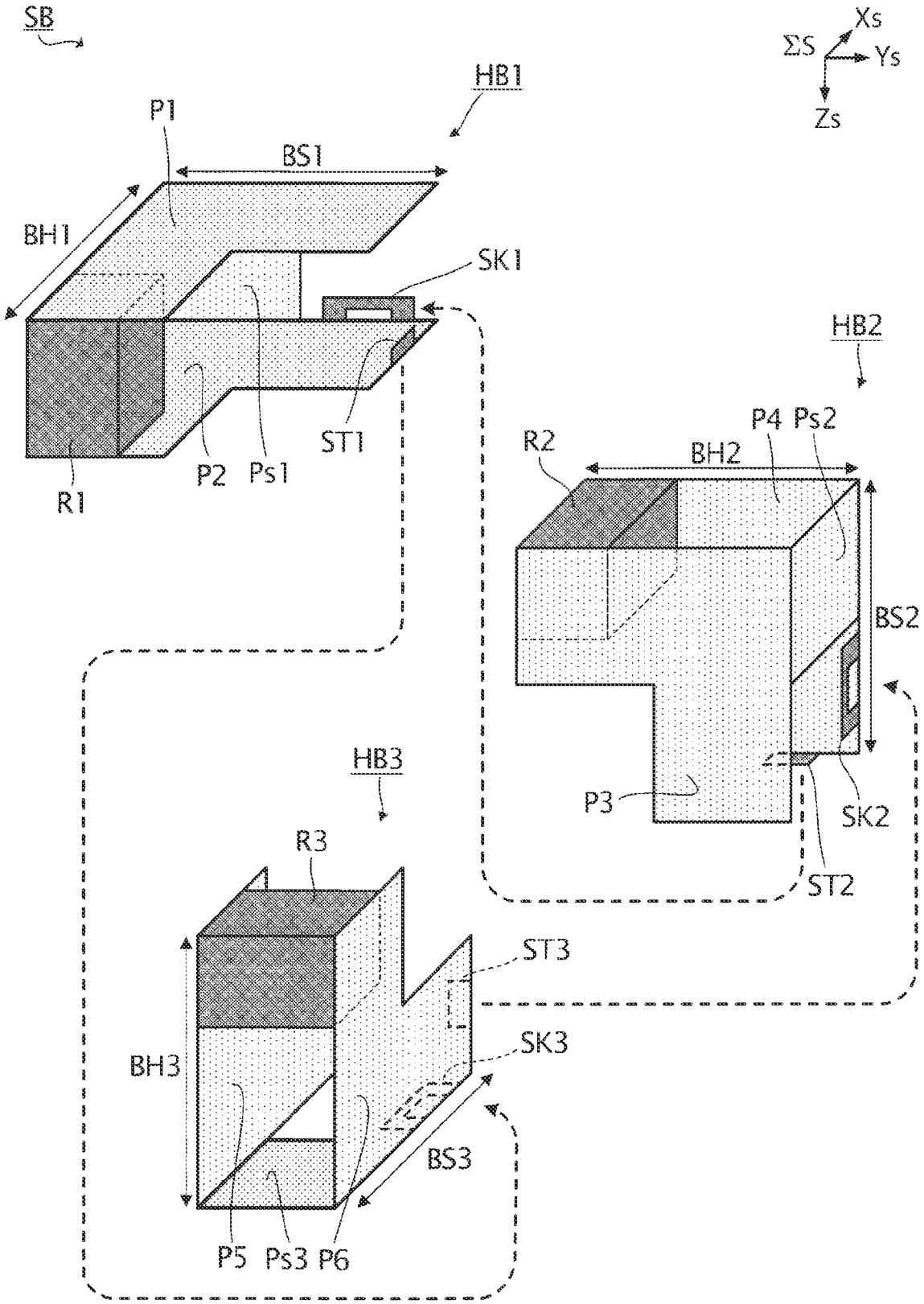
FIG. 8 is an exploded perspective view illustrating an example of a structure of a cushioning material SB according to a modification example 2 of the present disclosure.
Figure 9:
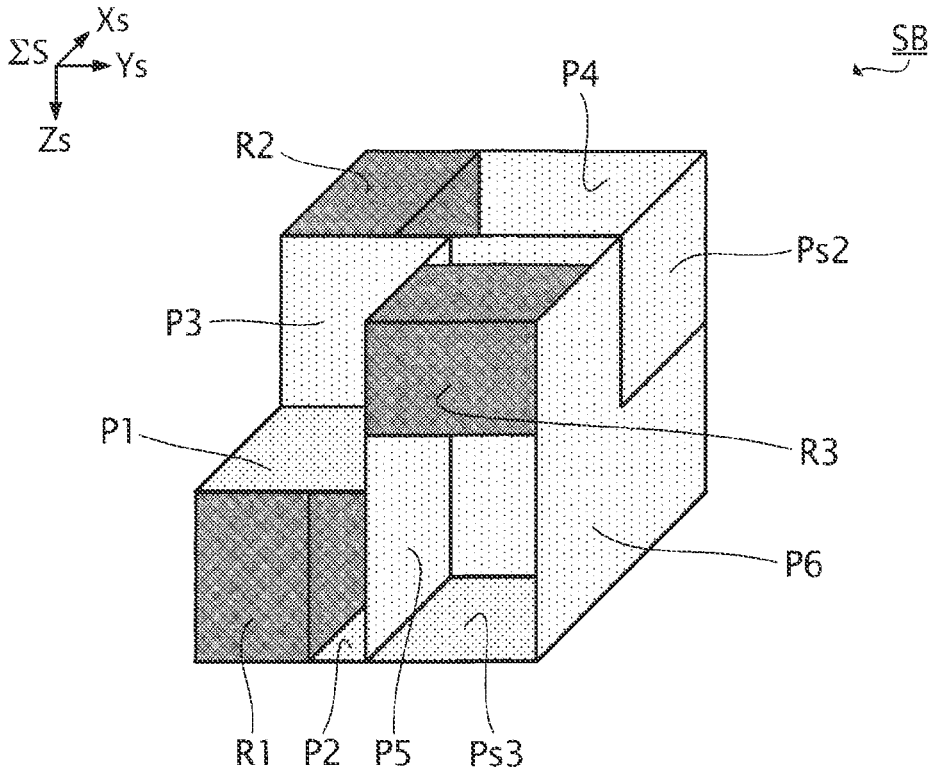
FIG. 9 is a perspective view illustrating an example of the structure of the cushioning material SB.

FIG. 8 is an exploded perspective view illustrating an example of a structure of a cushioning material SB of a packing material according to the present modification example. FIG. 9 is a perspective view illustrating an example of the structure of the cushioning material SB of the packing material according to the present modification example.

As illustrated in FIG. 8, in the present modification example, the cushioning material SB is comprised of three holders HB1, HB2, and HB3. In the present modification example, the holder HB1 is coupled to the holder HB2 and the holder HB3, the holder HB2 is coupled to the holder HB1 and the holder HB3, and the holder HB3 is coupled to the holder HB1 and the holder HB2. The holders HB1, HB2, and HB3 may be hereinafter collectively referred to as "holder(s) HB".

The holder HB1 includes the holder plate P1, the holder plate P2, a junction protrusion member ST1, and a junction opening member SK1, and holds the cushioning block R1. In the description below, a structural part, of the holder HB1, for holding the cushioning block R1 will be referred to as "holding portion BH1", and a structural part, of the holder HB1, for coupling the holder HB1 to the holder HB2 and the holder HB3 will be referred to as "coupling portion BS1".

The holding portion BH1 is a structural part, of the holder plate P1 and the holder plate P2, extending in the +Xs direction. In the present modification example, one end of the cushioning block R1 is bonded to the part, of the holder plate P1, corresponding to the holding portion BH1 by means of adhesive, and the other end of the cushioning block R1 is bonded to the part, of the holder plate P2, corresponding to the holding portion BH1 by means of adhesive.

The coupling portion BS1 includes a structural part, of the holder plate P1 and the holder plate P2, extending in the +Ys direction, the junction protrusion member ST1, and the junction opening member SK1. The junction protrusion member ST1 is a leaf-type member extending in the −Zs direction. One end of the junction protrusion member ST1 is continuous to the holder plate P2 at the +Ys-side edge of the holder plate P2, which is a part included in the coupling portion BS1 of the holder plate P2. The junction opening member SK1 is a leaf-type member having an opening and extending in the −Zs direction. One end of the junction opening member SK1 is continuous to the holder plate P2 at the +Xs-side edge of the holder plate P2, which is a part included in the coupling portion BS1 of the holder plate P2.

In the present modification example, the holding portion BH1 is an example of "a first holding portion", the coupling portion BS1 is an example of "a first coupling portion", the +Zs direction is an example of "a first direction", the +Xs direction is an example of "a second direction", and the +Ys direction is an example of "a third direction".

The holder HB2 includes the holder plate P3, the holder plate P4, a junction protrusion member ST2, and a junction opening member SK2, and holds the cushioning block R2. In the description below, a structural part, of the holder HB2, for holding the cushioning block R2 will be referred to as "holding portion BH2", and a structural part, of the holder HB2, for coupling the holder HB2 to the holder HB1 and the holder HB3 will be referred to as "coupling portion BS2".

The holding portion BH2 is a structural part, of the holder plate P3 and the holder plate P4, extending in the +Ys direction. In the present modification example, one end of the cushioning block R2 is bonded to the part, of the holder plate P3, corresponding to the holding portion BH2 by means of adhesive, and the other end of the cushioning block R2 is bonded to the part, of the holder plate P4, corresponding to the holding portion BH2 by means of adhesive.

The coupling portion BS2 includes a structural part, of the holder plate P3 and the holder plate P4, extending in the +Zs direction, the junction protrusion member ST2, and the junction opening member SK2. The junction protrusion member ST2 is a leaf-type member extending in the −Xs direction. One end of the junction protrusion member ST2 is continuous to the holder plate P4 at the +Zs-side edge of the holder plate P4, which is a part included in the coupling portion BS2 of the holder plate P4. The junction opening member SK2 is a leaf-type member having an opening and extending in the −Xs direction. One end of the junction opening member SK2 is continuous to the holder plate P4 at the +Ys-side edge of the holder plate P4, which is a part included in the coupling portion BS2 of the holder plate P4.

In the present modification example, the holding portion BH2 is an example of "a second holding portion", and the coupling portion BS2 is an example of "a second coupling portion".

The holder HB3 includes the holder plate P5, the holder plate P6, a junction protrusion member ST3, and a junction opening member SK3, and holds the cushioning block R3. In the description below, a structural part, of the holder HB3, for holding the cushioning block R3 will be referred to as "holding portion BH3", and a structural part, of the holder HB3, for coupling the holder HB3 to the holder HB1 and the holder HB2 will be referred to as "coupling portion BS3".

The holding portion BH3 is a structural part, of the holder plate P5 and the holder plate P6, extending in the +Zs direction. In the present modification example, one end of the cushioning block R3 is bonded to the part, of the holder plate P5, corresponding to the holding portion BH3 by means of adhesive, and the other end of the cushioning block R3 is bonded to the part, of the holder plate P6, corresponding to the holding portion BH3 by means of adhesive.

The coupling portion BS3 includes a structural part, of the holder plate P5 and the holder plate P6, extending in the +Xs direction, the junction protrusion member ST3, and the junction opening member SK3. The junction protrusion member ST3 is a leaf-type member extending in the −Ys direction. One end of the junction protrusion member ST3 is continuous to the holder plate P6 at the +Xs-side edge of the holder plate P6, which is a part included in the coupling portion BS3 of the holder plate P6. The junction opening member SK3 is a leaf-type member having an opening and extending in the −Ys direction. One end of the junction opening member SK3 is continuous to the holder plate P6 at the +Zs-side edge of the holder plate P6, which is a part included in the coupling portion BS3 of the holder plate P6.

In the present modification example, the holding portion BH3 is an example of "a third holding portion", and the coupling portion BS3 is an example of "a third coupling portion".

In the present modification example, the junction protrusion member ST1 is inserted into the opening provided in the junction opening member SK3, the junction protrusion member ST2 is inserted into the opening provided in the junction opening member SK1, and the junction protrusion member ST3 is inserted into the opening provided in the junction opening member SK2, thereby coupling the holder HB1, the holder HB2, and the holder HB3 to one another to form the cushioning material SB illustrated in FIG. 9.

In the present modification example, a case where the cushioning block R is bonded to the holding portion BH by means of adhesive has been taken as an example. However, the scope of the present disclosure is not limited to such an exemplary structure. For example, in the present modification example, as illustrated in FIGS. 6 and 7, the holding portion BH may include two arrangement plates BB each having an opening HK, and the cushioning block R may be held by the holding portion BH by insertion of its both ends into the two openings HK corresponding to the two arrangement plates BB. In this case, the cushioning block R may be fixed to the holding portion BH without using any adhesive.

As described above, the cushioning material SB according to the present modification example comprises the holder HB1, the cushioning block R1, the holder HB2, and the cushioning block R2. The holder HB1 includes the holder plate P1 and the holder plate P2. The holder plate P1 is configured to face the electronic equipment 100 when the cushioning material SB and the electronic equipment 100 are encased in the packing box 2. The holder plate P2 is configured to face an inner wall surface of the packing box 2 when the cushioning material SB and the electronic equipment 100 are encased in the packing box 2. The cushioning block R1 is provided between the holder plate P1 and the holder plate P2. The holder HB2 includes the holder plate P3 and the holder plate P4. The holder plate P3 is configured to face the electronic equipment 100 when the cushioning material SB and the electronic equipment 100 are encased in the packing box 2. The holder plate P4 is configured to face an inner wall surface of the packing box 2 when the cushioning material SB and the electronic equipment 100 are encased in the packing box 2. The cushioning block R2 is provided between the holder plate P3 and the holder plate P4. The holder HB1 has the holding portion BH1 and the coupling portion BS1. The holding portion BH1 holds the cushioning block R1 between the holder plate P1 and the holder plate P2 and extends in the +Xs direction. The coupling portion BS1 extends in the +Ys direction. The holder HB2 has the holding portion BH2 and the coupling portion BS2. The holding portion BH2 holds the cushioning block R2 between the holder plate P3 and the holder plate P4. The coupling portion BS2 is coupled to the coupling portion BS1. The cushioning block R2 extends in the +Xs direction. The holding portion BH2 extends in the +Ys direction. The coupling portion BS2 extends in the +Zs direction.

Therefore, the present modification example makes it possible to absorb external stress applied from the +Zs directional side and external stress applied from the +Xs directional side.

The cushioning material SB according to the present modification example further comprises the holder HB3 and the cushioning block R3. The holder HB3 includes the holder plate P5 and the holder plate P6. The holder plate P5 is configured to face the electronic equipment 100 when the cushioning material SB and the electronic equipment 100 are encased in the packing box 2. The holder plate P6 is configured to face an inner wall surface of the packing box 2 when the cushioning material SB and the electronic equipment 100 are encased in the packing box 2. The cushioning block R3 is provided between the holder plate P5 and the holder plate P6. The holder HB3 has the holding portion BH3 and the coupling portion BS3. The holding portion BH3 holds the cushioning block R3 between the holder plate P5 and the holder plate P6. The coupling portion BS3 is coupled to the coupling portion BS1 and the coupling portion BS2. The cushioning block R3 extends in the +Ys direction. The holding portion BH3 extends in the +Zs direction. The coupling portion BS3 extends in the +Xs direction.

Therefore, the present modification example makes it possible to absorb external stress applied from the +Zs directional side, external stress applied from the +Xs directional side, and external stress applied from the +Ys directional side.

Modification Example 3

In the exemplary embodiment and the modification examples 1 and 2 described above, a case where the packing material includes eight pieces of cushioning material has been taken as an example. However, the scope of the present disclosure is not limited to such an exemplary structure. For example, the number of pieces of cushioning material included in the packing material may be less than eight.

Figure 10:
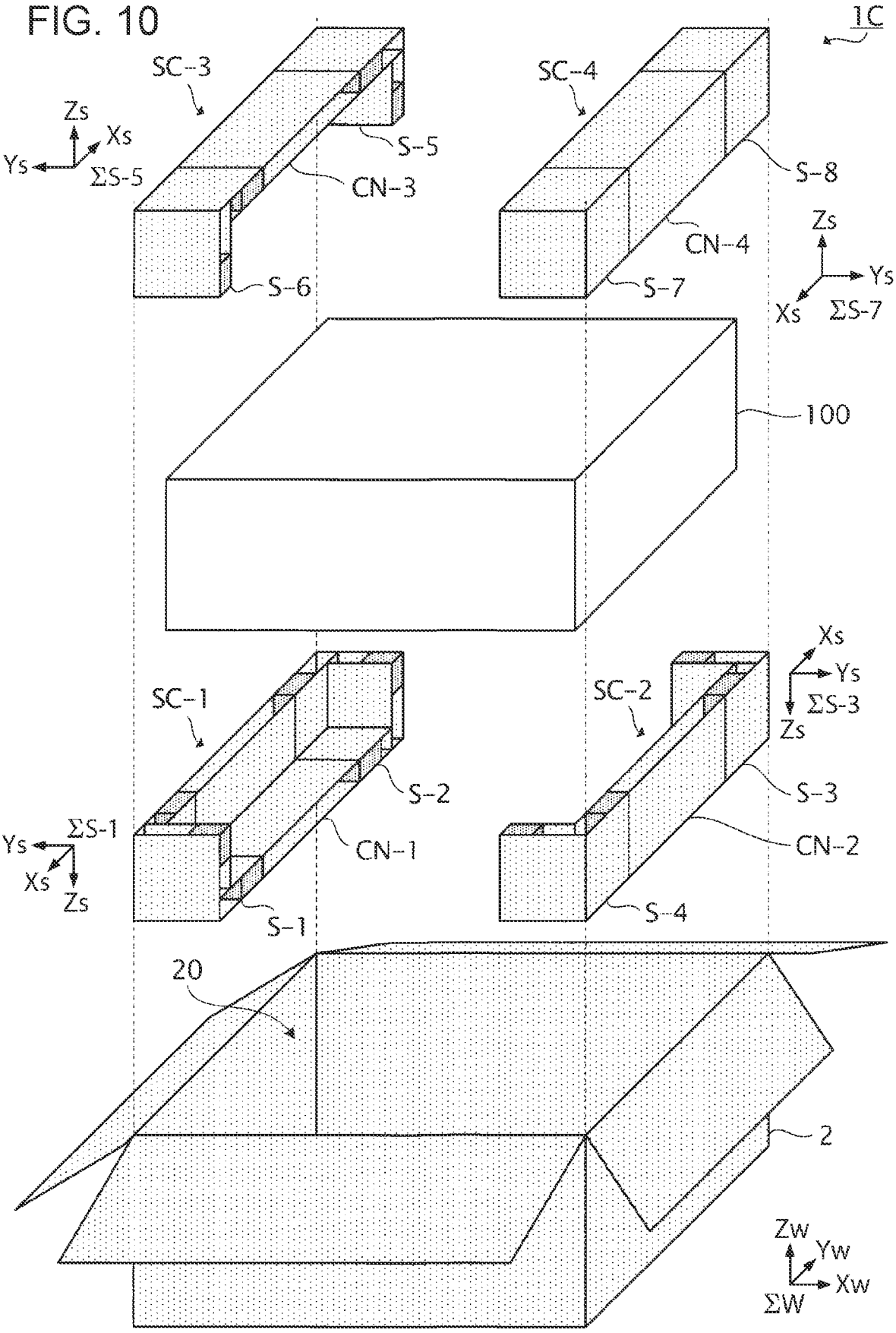
FIG. 10 is an exploded perspective view illustrating an example of a structure of a packing material according to a modification example 3 of the present disclosure.

FIG. 10 is an exploded perspective view illustrating an example of a structure of a packing material 1C according to the present modification example.

As illustrated in FIG. 10, the packing material 1C according to the present modification example is different from the packing material 1 according to the exemplary embodiment in that it includes four pieces of cushioning material SC in place of the eight pieces of cushioning material S. Specifically, the packing material 1C is different from the packing material 1 according to the exemplary embodiment in that it includes the four pieces of cushioning material SC-1 to SC-4 in place of the eight pieces of cushioning material S-1 to S-8.

The cushioning material SC-1 includes the cushioning material S-1, the cushioning material S-2, and a link material CN-1 linking the cushioning material S-1 and the cushioning material S-2 to each other. The cushioning material SC-2 includes the cushioning material S-3, the cushioning material S-4, and a link material CN-2 linking the cushioning material S-3 and the cushioning material S-4 to each other. The cushioning material SC-3 includes the cushioning material S-5, the cushioning material S-6, and a link material CN-3 linking the cushioning material S-5 and the cushioning material S-6 to each other. The cushioning material SC-4 includes the cushioning material S-7, the cushioning material S-8, and a link material CN-4 linking the cushioning material S-7 and the cushioning material S-8 to each other.

The link material CN-1, CN-2, CN-3, and CN-4 may be hereinafter collectively referred to as "link material CN". The cushioning material S-1, S-3, S-5, and S-7 may be hereinafter collectively referred to as "cushioning material S-P". The cushioning material S-2, S-4, S-6, and S-8 may be hereinafter collectively referred to as "cushioning material S-Q". That is, in the present modification example, the cushioning material SC includes the cushioning material S-P, the cushioning material S-Q, and the link material CN linking the cushioning material S-P and the cushioning material S-Q to each other. In the present modification example, a case where the cushioning material SC is made of a single flat plate-like member HHC is taken as an example.

Figure 11:
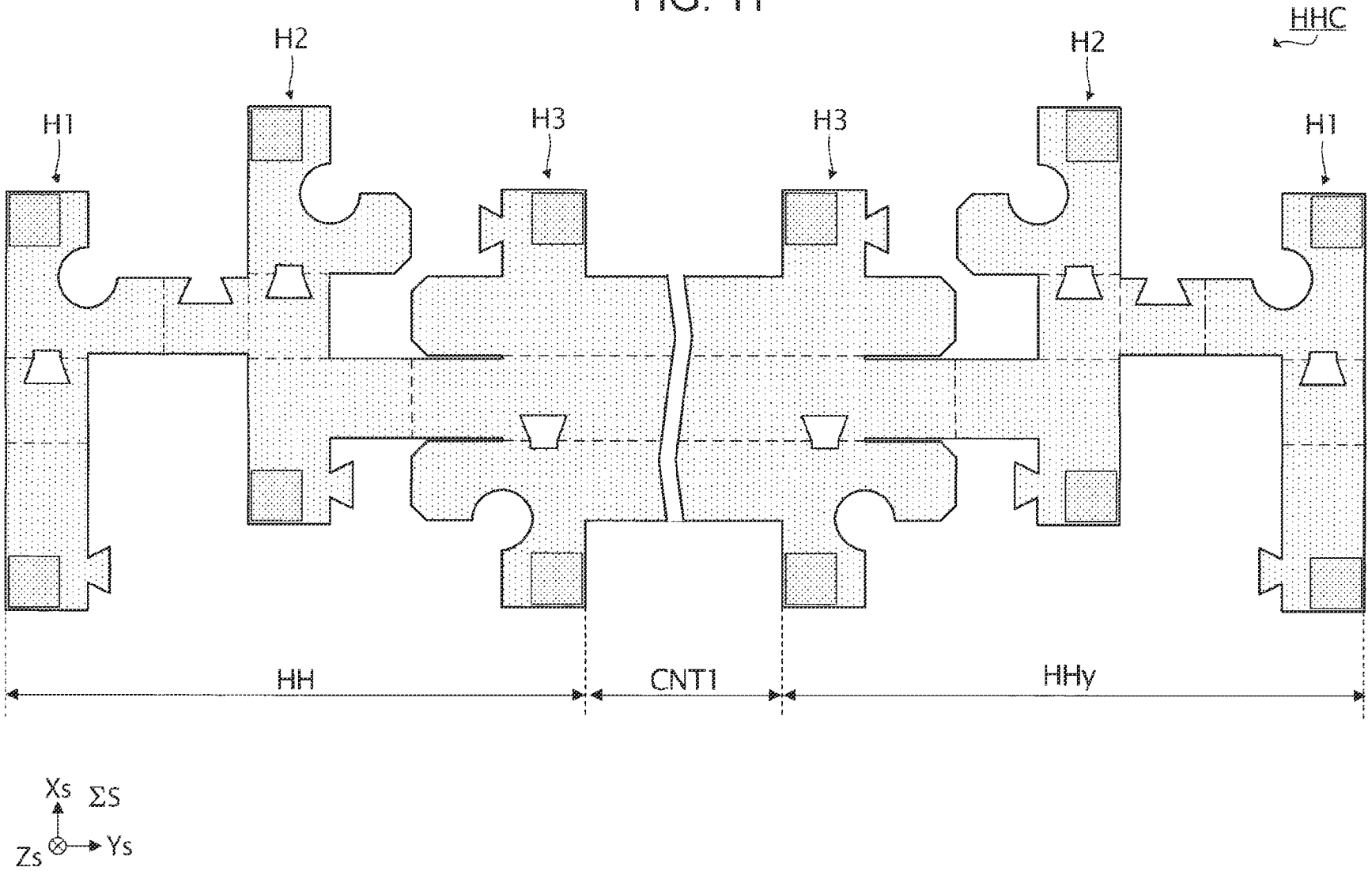
FIG. 11 is a plan view illustrating an example of a shape of a flat plate-like member HHC.

FIG. 11 is a plan view illustrating an example of a shape of a flat plate-like member HHC.

As illustrated in FIG. 11, the flat plate-like member HHC includes the flat plate-like member HH illustrated in FIG. 3, a flat plate-like member HHy, which has a shape obtained by inverting the flat plate-like member HH by mirror reversal in terms of the +Ys direction and the −Ys direction, and a linking flat plate-like member CNT1, which links the flat plate-like member HH and the flat plate-like member HHy to each other. The cushioning material SC is formed by folding the flat plate-like member HHC along dotted lines and dot-and-dash lines. Specifically, the cushioning material S-P is formed by folding the flat plate-like member HH along dotted lines and a dot-and-dash line. The cushioning material S-Q is formed by folding the flat plate-like member HHy along dotted lines and a dot-and-dash line. The link material CN is formed by folding the linking flat plate-like member CNT1 along dotted lines. In FIG. 11, each dotted line indicates a valley fold line, and each dot-and-dash line indicates a mountain fold line, similarly to FIG. 3. In FIG. 11, the following case is assumed as an example: a case where the cushioning material coordinate system ΣS is a coordinate system fixed to the holder plate P2 of the cushioning material S-P and where the flat plate-like member HHC is obtained by developing (flattening) the cushioning material S-P, the cushioning material S-Q, and the link material CN in a state in which the cushioning material coordinate system ΣS is fixed to the holder plate P2 of the cushioning material S-P.

In the description below, the holder H1 of the cushioning material S-P will be referred to as "holder H1-P", the holder H2 of the cushioning material S-P will be referred to as "holder H2-P", the holder plate P1 of the holder H1-P will be referred to as "holder plate P1-P", the holder plate P2 of the holder H1-P will be referred to as "holder plate P2-P", the holder plate P3 of the holder H2-P will be referred to as "holder plate P3-P", the holder plate P4 of the holder H2-P will be referred to as "holder plate P4-P", the cushioning block R1 provided between the holder plate P1-P and the holder plate P2-P will be referred to as "cushioning block R1-P", and the cushioning block R2 provided between the holder plate P3-P and the holder plate P4-P will be referred to as "cushioning block R2-P". In the description below, the holder H1 of the cushioning material S-Q will be referred to as "holder H1-Q", the holder H2 of the cushioning material S-Q will be referred to as "holder H2-Q", the holder plate P1 of the holder H1-Q will be referred to as "holder plate P1-Q", the holder plate P2 of the holder H1-Q will be referred to as "holder plate P2-Q", the holder plate P3 of the holder H2-Q will be referred to as "holder plate P3-Q", the holder plate P4 of the holder H2-Q will be referred to as "holder plate P4-Q", the cushioning block R1 provided between the holder plate P1-Q and the holder plate P2-Q will be referred to as "cushioning block R1-Q", and the cushioning block R2 provided between the holder plate P3-Q and the holder plate P4-Q will be referred to as "cushioning block R2-Q".

As described above, the cushioning material SC according to the present modification example is a cushioning material for being put into the packing box 2 configured for encasement of the electronic equipment 100. The cushioning material is configured to absorb external stress applied to the electronic equipment 100 encased in the packing box 2. The cushioning material comprises the holder H1-P, the cushioning block R1-P, the holder H2-P, the cushioning block R2-P, the holder H1-Q, the cushioning block R1-Q, the holder H2-Q, and the cushioning block R2-Q. The holder H1-P includes the holder plate P1-P and the holder plate P2-P. The holder plate P1-P is configured to face the electronic equipment 100 when the cushioning material SC and the electronic equipment 100 are encased in the packing box 2. The holder plate P2-P is configured to face an inner wall surface of the packing box 2 when the cushioning material SC and the electronic equipment 100 are encased in the packing box 2. The cushioning block R1-P is provided between the holder plate P1-P and the holder plate P2-P. The holder H2-P includes the holder plate P3-P and the holder plate P4-P. The holder plate P3-P is configured to face the electronic equipment 100 when the cushioning material SC and the electronic equipment 100 are encased in the packing box 2. The holder plate P4-P is configured to face an inner wall surface of the packing box 2 when the cushioning material SC and the electronic equipment 100 are encased in the packing box 2. The cushioning block R2-P is provided between the holder plate P3-P and the holder plate P4-P. The holder H1-Q includes the holder plate P1-Q and the holder plate P2-Q. The holder plate P1-Q is configured to face the electronic equipment 100 when the cushioning material SC and the electronic equipment 100 are encased in the packing box 2. The holder plate P2-Q is configured to face an inner wall surface of the packing box 2 when the cushioning material SC and the electronic equipment 100 are encased in the packing box 2. The cushioning block R1-Q is provided between the holder plate P1-Q and the holder plate P2-Q. The holder H2-Q includes the holder plate P3-Q and the holder plate P4-Q. The holder plate P3-Q is configured to face the electronic equipment 100 when the cushioning material SC and the electronic equipment 100 are encased in the packing box 2. The holder plate P4-Q is configured to face an inner wall surface of the packing box 2 when the cushioning material SC and the electronic equipment 100 are encased in the packing box 2. The cushioning block R2-Q is provided between the holder plate P3-Q and the holder plate P4-Q. The cushioning block R1-P extends in the +Zs direction going from the holder plate P1-P toward the holder plate P2-P. The cushioning block R2-P extends in the +Xs direction going from the holder plate P3-P toward the holder plate P4-P. The cushioning block R1-Q extends in the +Zs direction going from the holder plate P1-Q toward the holder plate P2-Q The cushioning block R2-Q extends in the +Ys direction going from the holder plate P3-Q toward the holder plate P4-Q. The holder H1-P, the holder H2-P, the holder H1-Q, and the holder H2-Q are made of a single flat plate-like member HHC. The holder H1-P and the holder H2-P are disposed as holders of the cushioning material S-P at a position that corresponds to one of a plurality of corners of the electronic equipment 100 when the cushioning material SC and the electronic equipment 100 are encased in the packing box 2. The holder H1-Q and the holder H2-Q are disposed as holders of the cushioning material S-Q at a position that corresponds to another one of the plurality of corners of the electronic equipment 100 when the cushioning material SC and the electronic equipment 100 are encased in the packing box 2.

Therefore, the present modification example makes it possible to absorb external stress applied from the +Zs directional side, external stress applied from the +Xs directional side, and external stress applied from the +Ys directional side. Therefore, in the present modification example, as long as the packing material 1C includes at least four pieces of the cushioning material SC, it is sufficient for absorbing external stress applied in every direction. Alternatively, in the present modification example, as long as the packing material 1C includes at least two pieces of the cushioning material SC, it is sufficient for absorbing external stress applied from the −Zw-directional side.

In the present modification example, the holder H1-P is an example of "a first holder", the holder H2-P is an example of "a second holder", the holder H1-Q is an example of "a third holder", the holder H2-Q is an example of "a fourth holder", the holder plate P1-P is an example of "a first plate", the holder plate P2-P is an example of "a second plate", the holder plate P3-P is an example of "a third plate", and the holder plate P4-P is an example of "a fourth plate", the holder plate P1-Q is an example of "a fifth plate", the holder plate P2-Q is an example of "a sixth plate", the holder plate P3-Q is an example of "a seventh plate", and the holder plate P4-Q is an example of "an eighth plate". In the present modification example, the +Zs direction is an example of "a first direction", the +Xs direction is an example of "a second direction", the +Zs direction is an example of "a third direction", the +Ys direction is an example of "a fourth direction".

Modification Example 4

In the modification example 3 described above, among the plural pieces of cushioning material SC of the packing material 1C, the cushioning material SC-1 is made of a member that is different from a member of which the cushioning material SC-2 is made. However, the scope of the present disclosure is not limited to such an exemplary structure. Among the plural pieces of cushioning material SC of the packing material 1C, the cushioning material SC-1 and the cushioning material SC-2 may be made of a single flat plate-like member. Similarly, among the plural pieces of cushioning material SC of the packing material 1C, the cushioning material SC-3 and the cushioning material SC-4 may be made of a single flat plate-like member.

Figure 12:
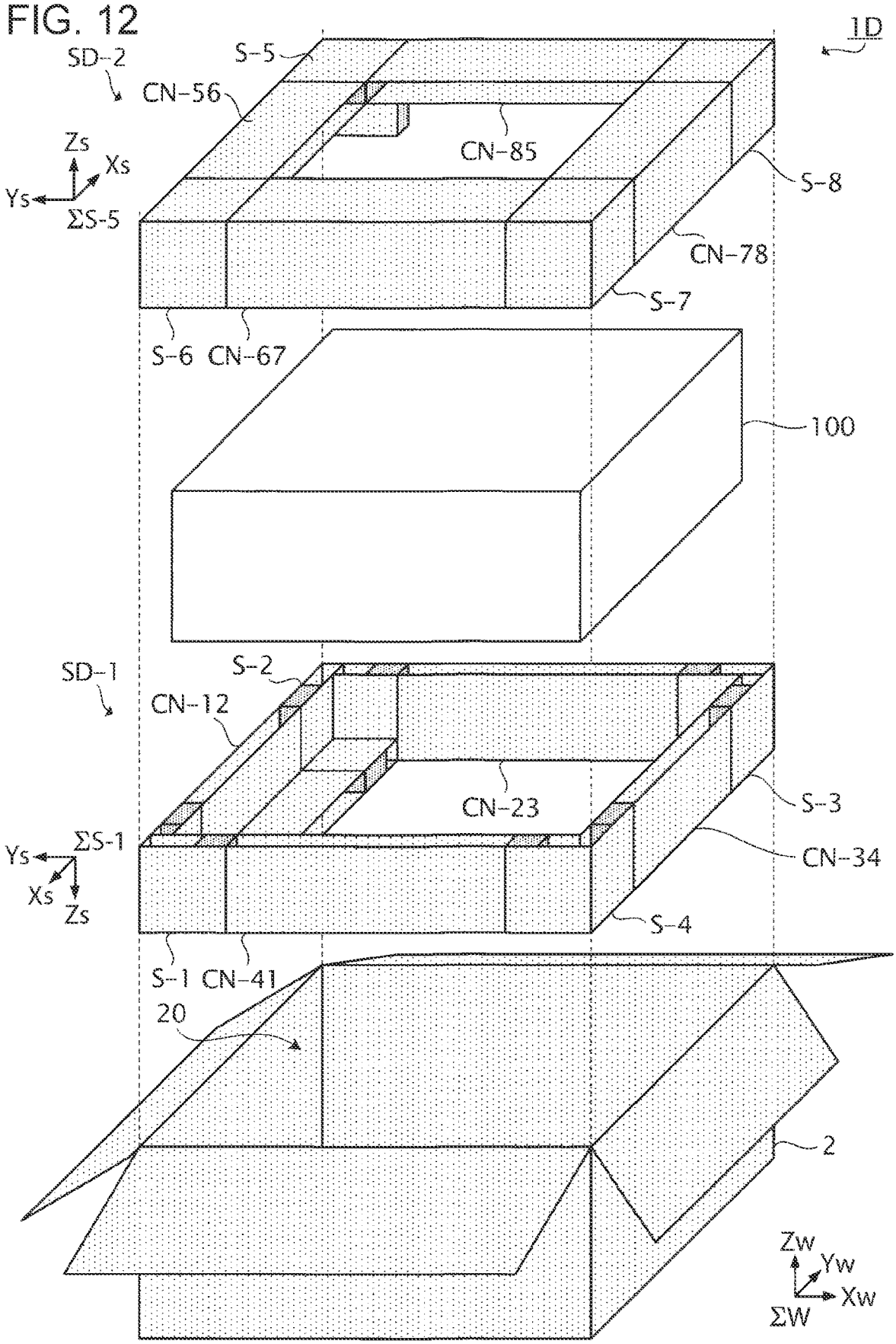
FIG. 12 is an exploded perspective view illustrating an example of a structure of a packing material according to a modification example 4 of the present disclosure.

FIG. 12 is an exploded perspective view illustrating an example of a structure of a packing material 1D according to the present modification example.

As illustrated in FIG. 12, the packing material 1D according to the present modification example is different from the packing material 1C according to the modification example 3 in that it includes two pieces of cushioning material SD in place of the four pieces of cushioning material SC. Specifically, the packing material 1D is different from the packing material 1C according to the modification example 3 in that it includes the two pieces of cushioning material SD-1 and SD-2 in place of the four pieces of cushioning material SC-1 to SC-4.

The cushioning material SD-1, one of the two, includes the cushioning material S-1, the cushioning material S-2, the cushioning material S-3, the cushioning material S-4, a link material CN-12 linking the cushioning material S-1 and the cushioning material S-2 to each other, a link material CN-23 linking the cushioning material S-2 and the cushioning material S-3 to each other, a link material CN-34 linking the cushioning material S-3 and the cushioning material S-4 to each other, and a link material CN-41 linking the cushioning material S-4 and the cushioning material S-1 to each other. The cushioning material SD-2 includes the cushioning material S-5, the cushioning material S-6, the cushioning material S-7, the cushioning material S-8, a link material CN-56 linking the cushioning material S-5 and the cushioning material S-6 to each other, a link material CN-67 linking the cushioning material S-6 and the cushioning material S-7 to each other, a link material CN-78 linking the cushioning material S-7 and the cushioning material S-8 to each other, and a link material CN-85 linking the cushioning material S-8 and the cushioning material S-5 to each other.

The cushioning material S-1 and S-5 may be hereinafter collectively referred to as "cushioning material S-F1". The cushioning material S-2 and S-6 may be hereinafter collectively referred to as "cushioning material S-F2". The cushioning material S-3 and S-7 may be hereinafter collectively referred to as "cushioning material S-F3". The cushioning material S-4 and S-8 may be hereinafter collectively referred to as "cushioning material S-F4". The link material CN-12 and CN-56 may be hereinafter collectively referred to as "link material CN-F12". The link material CN-23 and CN-67 may be hereinafter collectively referred to as "link material CN-F23". The link material CN-34 and CN-78 may be hereinafter collectively referred to as "link material CN-F34". The link material CN-41 and CN-85 may be hereinafter collectively referred to as "link material CN-F41".

That is, in the present modification example, the cushioning material SD includes the cushioning material S-F1, the cushioning material S-F2, the cushioning material S-F3, the cushioning material S-F4, the link material CN-F12 linking the cushioning material S-F1 and the cushioning material S-F2 to each other, the link material CN-F23 linking the cushioning material S-F2 and the cushioning material S-F3 to each other, the link material CN-F34 linking the cushioning material S-3 and the cushioning material S-4 to each other, and the link material CN-F41 linking the cushioning material S-F4 and the cushioning material S-F1 to each other. In the present modification example, a case where the cushioning material SD is made of a single flat plate-like member HHD is taken as an example.

Figure 13:
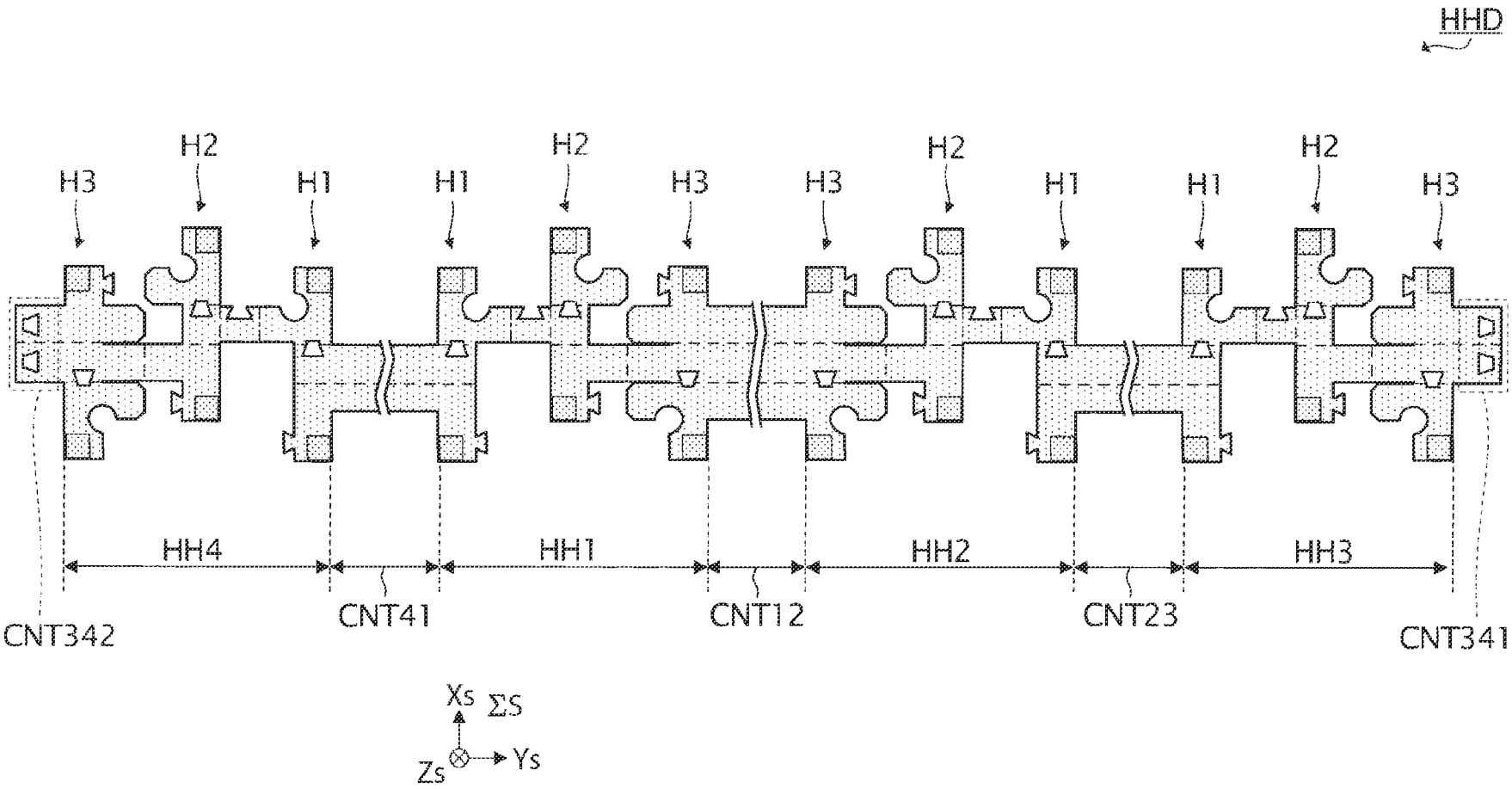
FIG. 13 is a plan view illustrating an example of a shape of a flat plate-like member HHD.

FIG. 13 is a plan view illustrating an example of a shape of a flat plate-like member HHD.

As illustrated in FIG. 13, the flat plate-like member HHD includes a flat plate-like member HH1, a flat plate-like member HH2, a flat plate-like member HH3, and a flat plate-like member HH4. Each of the flat plate-like member HH1 and the flat plate-like member HH3 has the same shape as that of the flat plate-like member HH illustrated in FIG. 3. Each of the flat plate-like member HH2 and the flat plate-like member HH4 has the same shape as that of the flat plate-like member HHy illustrated in FIG. 11.

The flat plate-like member HHD further includes a linking flat plate-like member CNT12, which links the flat plate-like member HH1 and the flat plate-like member HH2 to each other, a linking flat plate-like member CNT23, which links the flat plate-like member HH2 and the flat plate-like member HH3 to each other, a linking flat plate-like member CNT41, which links the flat plate-like member HH4 and the flat plate-like member HH1 to each other, a linking flat plate-like member CNT341, which is continuous to the flat plate-like member HH3, and a linking flat plate-like member CNT342, which links the linking flat plate-like member CNT341 and the flat plate-like member HH4 to each other.

The cushioning material SD is formed by folding the flat plate-like member HHD along dotted lines and dot-and-dash lines.

Specifically, the cushioning material S-F1 is formed by folding the flat plate-like member HH1 along dotted lines and a dot-and-dash line. The cushioning material S-F2 is formed by folding the flat plate-like member HH2 along dotted lines and a dot-and-dash line. The cushioning material S-F3 is formed by folding the flat plate-like member HH3 along dotted lines and a dot-and-dash line. The cushioning material S-F4 is formed by folding the flat plate-like member HH4 along dotted lines and a dot-and-dash line. The link material CN-F12 is formed by folding the linking flat plate-like member CNT12 along dotted lines. The link material CN-F23 is formed by folding the linking flat plate-like member CNT23 along dotted lines. The link material CN-F41 is formed by folding the linking flat plate-like member CNT41 along dotted lines. The link material CN-F34 is formed by linking a member obtained by folding the linking flat plate-like member CNT341 along a dotted line and a member obtained by folding the linking flat plate-like member CNT342 along a dotted line together. In FIG. 13, each dotted line indicates a valley fold line, and each dot-and-dash line indicates a mountain fold line, similarly to FIG. 3. In FIG. 13, the following case is assumed as an example: a case where the cushioning material coordinate system ΣS is a coordinate system fixed to the holder plate P2 of the cushioning material S-F1 and where the flat plate-like member HHD is obtained by developing (flattening) the cushioning material S-F1 to S-F4, the linking flat plate-like member CNT12, the linking flat plate-like member CNT23, the linking flat plate-like member CNT41, the linking flat plate-like member CNT341, and the linking flat plate-like member CNT342 in a state in which the cushioning material coordinate system ΣS is fixed to the holder plate P2 of the cushioning material S-F1.

Therefore, the present modification example makes it possible to absorb external stress applied from the +Zs directional side, external stress applied from the +Xs directional side, external stress applied from the −Xs directional side, external stress applied from the +Ys directional side, and external stress applied from the −Ys directional side by means of the cushioning material SD. Therefore, in the present modification example, as long as the packing material 1D includes at least two pieces of the cushioning material SD, it is sufficient for absorbing external stress applied in every direction. Alternatively, in the present modification example, as long as the packing material 1D includes at least one piece of the cushioning material SD, it is sufficient for absorbing external stress applied from the −Zw-directional side.

Modification Example 5

In the exemplary embodiment and the modification examples 1 to 4 described above, the Xw axis, the Yw axis, and the Zw axis of the packing box coordinate system ΣW are orthogonal to one another. However, the scope of the present disclosure is not limited to such an exemplary structure. It is sufficient as long as the Xw axis, the Yw axis, and the Zw axis of the packing box coordinate system ΣW extend in directions different from one another.

In the exemplary embodiment and the modification examples 1 to 4 described above, the Xs axis, the Ys axis, and the Zs axis of the cushioning material coordinate system ΣS are orthogonal to one another. However, the scope of the present disclosure is not limited to such an exemplary structure. It is sufficient as long as the Xs axis, the Ys axis, and the Zs axis of the cushioning material coordinate system ΣS extend in directions different from one another.

Modification Example 6

In the exemplary embodiment and the modification examples 1 to 5 described above, a case where the packing material includes twenty-four cushioning blocks has been taken as an example. However, the scope of the present disclosure is not limited to such an exemplary structure. For example, the packing material according to the present disclosure may include one or more, but not more than twenty-three, cushioning blocks. Alternatively, the packing material according to the present disclosure may include twenty-five or more cushioning blocks.

What is claimed is:

1. A cushioning material for being put into a packing box configured for encasement of electronic equipment, the cushioning material being configured to absorb external stress applied to the electronic equipment encased in the packing box, the cushioning material comprising:

a first holder including a first plate configured to face the electronic equipment when the cushioning material and the electronic equipment are encased in the packing box, and a second plate configured to face an inner wall surface of the packing box when the cushioning material and the electronic equipment are encased in the packing box;

a first cushioning block provided between the first plate and the second plate;

a second holder including a third plate configured to face the electronic equipment when the cushioning material and the electronic equipment are encased in the packing box, and a fourth plate configured to face an inner wall surface of the packing box when the cushioning material and the electronic equipment are encased in the packing box; and a second cushioning block provided between the third plate and the fourth plate, wherein the first holder has a first holding portion holding the first cushioning block between the first plate and the second plate and extending in a second direction intersecting with a first direction, the first direction going from the first plate toward the second plate, and a first coupling portion extending in a third direction intersecting with both the first direction and the second direction, the second holder has a second holding portion holding the second cushioning block between the third plate and the fourth plate, and a second coupling portion coupled to the first coupling portion, the second cushioning block extends in the second direction going from the third plate toward the fourth plate, the second holding portion extends in the third direction, and the second coupling portion extends in the first direction.

2. The cushioning material according to claim 1, wherein the first cushioning block includes a plurality of cushioning sheets stacked in a first direction going from the first plate toward the second plate.

3. The cushioning material according to claim 1, wherein the first holder includes a first arrangement plate continuous at one end to the first plate and disposed between the first plate and the second plate, and a second arrangement plate continuous at one end to the second plate and disposed between the first plate and the second plate, one end of the first cushioning block is inserted into a first opening provided in the first arrangement plate, and an other end of the first cushioning block is inserted into a second opening provided in the second arrangement plate.

4. The cushioning material according to claim 1, further comprising:

a third holder including a fifth plate configured to face the electronic equipment when the cushioning material and the electronic equipment are encased in the packing box, and a sixth plate configured to face an inner wall surface of the packing box when the cushioning material and the electronic equipment are encased in the packing box; and a third cushioning block provided between the fifth plate and the sixth plate, wherein the third holder has a third holding portion holding the third cushioning block between the fifth plate and the sixth plate, and a third coupling portion coupled to both the first coupling portion and the second coupling portion, the third cushioning block extends in the third direction going from the fifth plate toward the sixth plate, the third holding portion extends in the first direction, and the third coupling portion extends in the second direction.

5. The cushioning material according to claim 1, the first cushioning block extends in a first direction going from the first plate toward the second plate, the second cushioning block extends in a second direction going from the third plate toward the fourth plate and intersecting with the first direction, and the first holder and the second holder are made of a single flat plate member.

6. The cushioning material according to claim 5, wherein a cavity is formed in the first plate and the third plate at a position that corresponds to a position where one of a plurality of corners of the electronic equipment will be placed when the cushioning material and the electronic equipment are encased in the packing box.

7. The cushioning material according to claim 5, further comprising:

a third holder including a fifth plate configured to face the electronic equipment when the cushioning material and the electronic equipment are encased in the packing box, and a sixth plate configured to face an inner wall surface of the packing box when the cushioning material and the electronic equipment are encased in the packing box;

a third cushioning block provided between the fifth plate and the sixth plate;

a fourth holder including a seventh plate configured to face the electronic equipment when the cushioning material and the electronic equipment are encased in the packing box, and an eighth plate configured to face an inner wall surface of the packing box when the cushioning material and the electronic equipment are encased in the packing box; and a fourth cushioning block provided between the seventh plate and the eighth plate, wherein the third cushioning block extends in a third direction going from the fifth plate toward the sixth plate, the fourth cushioning block extends in a fourth direction going from the seventh plate toward the eighth plate and intersecting with the third direction, the first holder, the second holder, the third holder, and the fourth holder are made of the single flat plate member, the first holder and the second holder are disposed at a position that corresponds to a position where one of a plurality of corners of the electronic equipment will be placed when the cushioning material and the electronic equipment are encased in the packing box, and the third holder and the fourth holder are disposed at a position that corresponds to another position where another one of the plurality of corners of the electronic equipment will be placed when the cushioning material and the electronic equipment are encased in the packing box.

8. A packing material, comprising:

a packing box configured for encasement of electronic equipment; and a cushioning material for being put into the packing box and configured to absorb external stress applied to the electronic equipment encased in the packing box, the cushioning material including a first holder including a first plate configured to face the electronic equipment when the cushioning material and the electronic equipment are encased in the packing box, and a second plate configured to face an inner wall surface of the packing box when the cushioning material and the electronic equipment are encased in the packing box;

a first cushioning block provided between the first plate and the second plate, a second holder including a third plate configured to face the electronic equipment when the cushioning material and the electronic equipment are encased in the packing box, and a fourth plate configured to face an inner wall surface of the packing box when the cushioning material and the electronic equipment are encased in the packing box; and a second cushioning block provided between the third plate and the fourth plate, wherein the first holder has a first holding portion holding the first cushioning block between the first plate and the second plate and extending in a second direction intersecting with a first direction, the first direction going from the first plate toward the second plate, and a first coupling portion extending in a third direction intersecting with both the first direction and the second direction, the second holder has a second holding portion holding the second cushioning block between the third plate and the fourth plate, and a second coupling portion coupled to the first coupling portion, the second cushioning block extends in the second direction going from the third plate toward the fourth plate, the second holding portion extends in the third direction, and the second coupling portion extends in the first direction.

9. Packed goods, comprising:

electronic equipment;

a packing box configured for encasement of the electronic equipment; and a cushioning material for being put into the packing box and configured to absorb external stress applied to the electronic equipment encased in the packing box, the cushioning material including a first holder including a first plate configured to face the electronic equipment when the cushioning material and the electronic equipment are encased in the packing box, and a second plate configured to face an inner wall surface of the packing box when the cushioning material and the electronic equipment are encased in the packing box;

a first cushioning block provided between the first plate and the second plate;

a second holder including a third plate configured to face the electronic equipment when the cushioning material and the electronic equipment are encased in the packing box, and a fourth plate configured to face an inner wall surface of the packing box when the cushioning material and the electronic equipment are encased in the packing box; and a second cushioning block provided between the third plate and the fourth plate, wherein the first holder has a first holding portion holding the first cushioning block between the first plate and the second plate and extending in a second direction intersecting with a first direction, the first direction going from the first plate toward the second plate, and a first coupling portion extending in a third direction intersecting with both the first direction and the second direction, the second holder has a second holding portion holding the second cushioning block between the third plate and the fourth plate, and a second coupling portion coupled to the first coupling portion, the second cushioning block extends in the second direction going from the third plate toward the fourth plate, the second holding portion extends in the third direction, and the second coupling portion extends in the first direction.

* * * * *